US009495890B2

(12) United States Patent
Murakami

(10) Patent No.: US 9,495,890 B2
(45) Date of Patent: Nov. 15, 2016

(54) AUTONOMOUSLY STANDING DISPLAY APPARATUS AND SUBSTRATE FOR AUTONOMOUSLY STANDING DISPLAY APPARATUS

(71) Applicant: Dai Nippon Printing Co., Ltd., Tokyo (JP)

(72) Inventor: Hiroshi Murakami, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 14/426,952

(22) PCT Filed: Aug. 26, 2013

(86) PCT No.: PCT/JP2013/072780

§ 371 (c)(1),
(2) Date: Mar. 9, 2015

(87) PCT Pub. No.: WO2014/041998

PCT Pub. Date: Mar. 20, 2014

(65) Prior Publication Data

US 2015/0228207 A1 Aug. 13, 2015

(30) Foreign Application Priority Data

Sep. 11, 2012 (JP) ..... 2012-199694
Feb. 5, 2013 (JP) ..... 2013-020701
Mar. 29, 2013 (JP) ..... 2013-074376

(51) Int. Cl.
*G09F 15/00* (2006.01)
*G09F 7/00* (2006.01)
*G09F 1/06* (2006.01)

(52) U.S. Cl.
CPC .. *G09F 7/00* (2013.01); *G09F 1/06* (2013.01)

(58) Field of Classification Search
None
See application file for complete search history.

(56) References Cited

U.S. PATENT DOCUMENTS 3,508,734 A 4/1970 Thomas
5,165,649 A * 11/1992 Neumann ..... A47B 23/044 206/45.26
2002/0104244 A1* 8/2002 Moss ..... G09F 1/065 40/610
2006/0070284 A1* 4/2006 Sparkowski ..... G09F 1/06 40/610
2012/0227297 A1* 9/2012 Kawaguchi ..... G09F 1/06 40/610

FOREIGN PATENT DOCUMENTS

GB EP 0537020 A1 * 4/1993 ..... G09F 9/377
JP 2004226876 A 8/2004
JP 2011098131 A 5/2011

OTHER PUBLICATIONS

Dainippon Printing Co., Ltd.; Microfilm of the specification and drawings annexed to the request of Japanese Utility Model Application No. 82769/1971 (Laid-open No. 39888/1973); May 18, 1973; entire text; Fig. 1 to 3.
International Search Report dated Nov. 7, 2013 for PCT/JP2013/072780.

* cited by examiner

*Primary Examiner* — Joanne Silbermann
(74) *Attorney, Agent, or Firm* — Locke Lord LLP

(57) ABSTRACT

Provided are an easily assembled and autonomously standing display apparatus and a substrate for the autonomously standing display apparatus. The autonomously standing display apparatus is provided with: a first side plate connected to a side of a first display board; a second display board connected to the bottom side of the first display board; a second side plate connected to the first side plate and the second display board; a bottom plate connected to the bottom side of the second display board; and a support plate, one side being connected to the bottom plate and the other side being rotatably connected to the back face of the first display board. In a vertical cross-sectional shape, the first display board and the second display board, which are deployed flat, and the bottom plate and the support plate, form sides of a triangle and maintain an open state.

14 Claims, 19 Drawing Sheets

501
60
66
523a
520
540
10
543a
L523a
L543a
L500
L501
L501 > L500
A
B
Z
Z1
Z2
Y
Y1
Y2

AUTONOMOUSLY STANDING DISPLAY APPARATUS AND SUBSTRATE FOR AUTONOMOUSLY STANDING DISPLAY APPARATUS

CROSS-REFERENCE TO RELATED APPLICATIONS

This application is the national phase under 35 U.S.C. §371 of PCT International Application No. PCT/JP2013/072780, filed Aug. 26, 2013, which claims the benefit of Japanese Application No. 2012-199694, filed Sept. 11, 2012; Japanese Patent Application No. 2013-020701, filed Feb. 5, 2013; and Japanese Patent Application No. 2013-074376, filed Mar. 29, 2013, the entire contents of the aforementioned applications are hereby incorporated herein by reference.

TECHNICAL FIELD

The present invention relates to a ready-to-assemble autonomously standing display apparatus and a plate member for the autonomously standing display apparatus.

BACKGROUND ART

Conventionally, there has been a display apparatus, which is assembled by fixing a display board to a support structure with a fixing member (for example, Patent Document 1).

However, the conventional display apparatus had a large number of parts, which makes the assembly process complicated and its assembly troublesome at a spot of displaying such as a shop.

Patent Document 1: Japanese Unexamined Patent Application, Publication No. 2004-226876

DISCLOSURE OF THE INVENTION

Problems to be Solved by the Invention

A problem to be solved by the present invention is to provide an easy-to-assemble autonomously standing display apparatus, and a plate member for the autonomously standing display apparatus.

Means for Solving the Problems

The present invention solves the problem by the following means for solving problem. In order to facilitate understanding, embodiments of the present invention will be described through assignment of corresponding reference numerals; however, the present invention is not limited thereto. Elements described through assignment of the reference numerals may be improved as appropriate, and/or may be replaced, at least in part, with other elements.

A first aspect of the present invention is an autonomously standing display apparatus, including: a first display board (10, 610, 710); a first side plate (11, 611) which is rotatably connected to a side edge of the first display board; a second display board (20, 620, 720) which is rotatably connected to a lower edge of the first display board; a second side plate (21, 521, 621) which is rotatably connected to the first side plate and the second display board; a bottom plate (30, 630, 730) which is rotatably connected to a lower edge of the second display board; and a support plate (40, 540, 640, 740), one edge of which is connected to an edge of the bottom plate opposite to the second display board and the other edge of which is rotatably connected to a back face of the first display board. The first side plate maintains an upstanding state in relation to the first display board and the second side plate maintains an upstanding state in relation to the second display board. The first side plate is connected with the second side plate by a hinge (63, 763), whereby the first side plate and the second side plate respectively maintain the upstanding states in relation to the first display board and the second display board, and the first display board and the second display board maintain a flat-deployed state, accordingly. The first display board and the second display board which are deployed flat, the bottom plate, and the support plate respectively form sides of a triangle (70) in a longitudinal sectional shape, such that the autonomously standing display apparatus maintains an opened state.

A second aspect of the present invention is the autonomously standing display apparatus according to the first aspect, in which the first display board (10, 610, 710) and the first side plate (11, 611) are deployed flat by rotating around a connection between the first display board and the first side plate; the second display board (20, 620, 720) and the second side plate (21, 521, 621) are deployed flat by rotating around a connection between the second display board and the second side plate; the first display board and the second display board are folded by rotating around a connection between the first display board and the second display board; the second display board and the bottom plate (30, 630, 730) are deployed flat by rotating around a connection between the second display board and the bottom plate; the bottom plate and the support plate (40, 540, 640, 740) are folded by rotating around a connection between the bottom plate and the support plate; and the support plate and the first display board are folded to stick together by rotating around a connection between the support plate and the first display board; whereby the autonomously standing display apparatus is folded flat as a whole.

A third aspect of the present invention is the autonomously standing display apparatus according to the first or second aspect, further including: a biasing member (50, 350, 550 (550-1,550-2), 650) for biasing the first side plate or the second side plate inward, such that the first side plate (11, 611) maintains the upstanding state in relation to the first display board (10, 610, 710) and the second side plate (21, 521, 621) maintains the upstanding state in relation to the second display board (20, 620, 720).

A fourth aspect of the present invention is the autonomously standing display apparatus according to any one of the first to third aspects, in which the biasing member biases the first side plate (11) or the second side plate (21) inward; and the first side plate is connected with the second side plate, whereby the first side plate and the second side plate, in conjunction with each other, respectively maintain the upstanding states in relation to the first display board (10) and the second display board (20): and the first display board and the second display board deploy autonomously flat, in conjunction with the upstanding of the first side plate and the second side plate; and the flat-deployed first display board and second display board, the bottom plate (30), and the support plate (40) change autonomously from a folded state into the opened state.

A fifth aspect of the present invention is the autonomously standing display apparatus according to the fourth aspect, in which the biasing member is an elastic member (550 (550-1, 550-2), one end (550-1*a*) of which is connected to the first side plate (11) or the second side plate (521), and the other end (550-1*b*) of which is connected to an inner face of the support plate (540).

A sixth aspect of the present invention is the autonomously standing display apparatus according to the fourth aspect, in which the biasing member is an elastic member, one end of which is connected to the second side plate, and the other end of which is connected to an inner face of the bottom plate.

A seventh aspect of the present invention is the autonomously standing display apparatus according to the fifth or sixth aspect, in which an attachment portion (623, 626) of the biasing member (650) of the first side plate (611) or the second side plate (621) is biased inward to abut on outer ends of the support plate (640).

An eighth aspect of the present invention is the autonomously standing display apparatus according to any one of the fifth to seventh aspects, in which at least one of the second display board (620) and the support plate (740) protrudes downward beyond the bottom plate (630, 730); and the second side plate (621, 721) abuts on outer ends of the bottom plate.

A ninth aspect of the present invention is the autonomously standing display apparatus according to any one of the first to eighth aspects, in which the second side plate (621, 721) has a foot part (625, 725) which projects frontward beyond the second display board (620, 720).

A tenth aspect of the present invention is the autonomously standing display apparatus according to any one of the first to ninth aspects, in which L1=L2 is satisfied, where L1 is a sum of a length of the second display board (20) and a length of the bottom plate (30); and L2 is a sum of a length of the support plate (40) and a length from the connection between the support plate and the first display board (10) to the connection between the first display board and the second display board.

An eleventh aspect of the present invention is the autonomously standing display apparatus according to any one of the first to ninth aspects, in which L61=L62+L63 is satisfied, where L61 is a length from the connection (660, 760) between the first display board (610, 710) and the second display board (620, 720) to the connection (664, 764) between the bottom plate (630, 730) and the support plate (640, 740); L62 is a length from the connection (660) between the first display board and the second display board to the connection (666, 766) between the first display board and the support plate; and L63 is a length from the connection between the first display board and the support plate to the connection between the support plate and the bottom plate.

Effects of the Invention

According to the present invention, an easy-to-assemble autonomously standing display apparatus can be provided.

EXPLANATION OF REFERENCE NUMERALS

Figure 1:
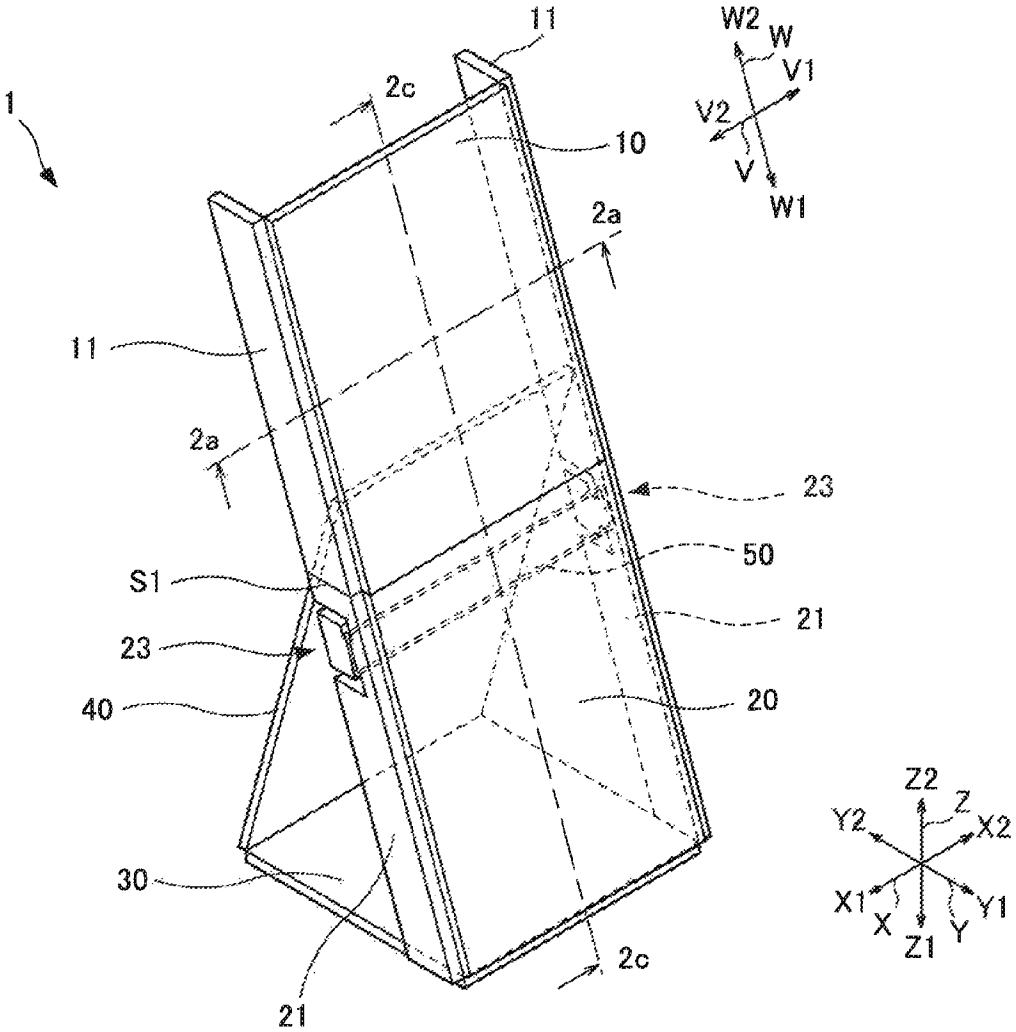
FIG. 1 is a perspective view of an autonomously standing display apparatus 1 in an autonomously standing state, according to a first embodiment.

1,1A, 1B, 201, 301, 401, 501, 601, 701: autonomously standing display apparatus
10, 610, 710: first display board
11, 611: first side plate
20, 620, 720: second display board
21, 521, 621: second side plate
30, 630, 730: bottom plate
40, 540, 640, 740: support plate
50, 350, 450, 550, 650: rubber
60-66, 660-666, 764-766: hinge
66*a*: hem
250: clip

PREFERRED MODE FOR CARRYING OUT THE INVENTION

First Embodiment

A first embodiment of the present invention will be hereinafter described with reference to the drawings.

FIG. 1 is a perspective view of an autonomously standing display apparatus 1 in an autonomously standing state, according to the first embodiment.

Figure 2C:
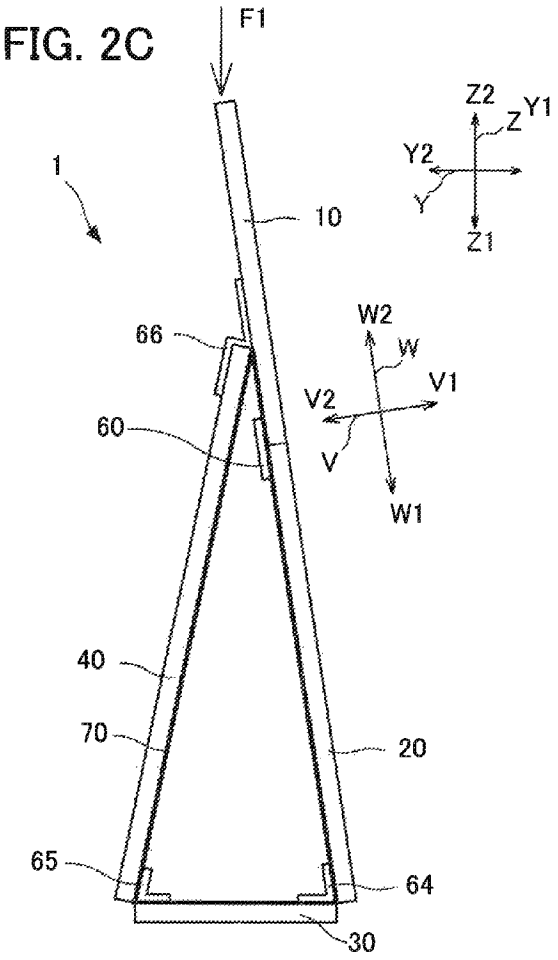
FIGS. 2A, 2B and 2C are cross-sectional views and a rear view of the autonomously standing display apparatus 1 in the autonomously standing state, according to the first embodiment.
Figure 2A:
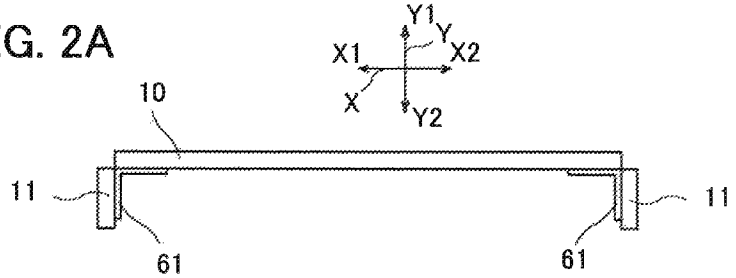
Figure 2B:
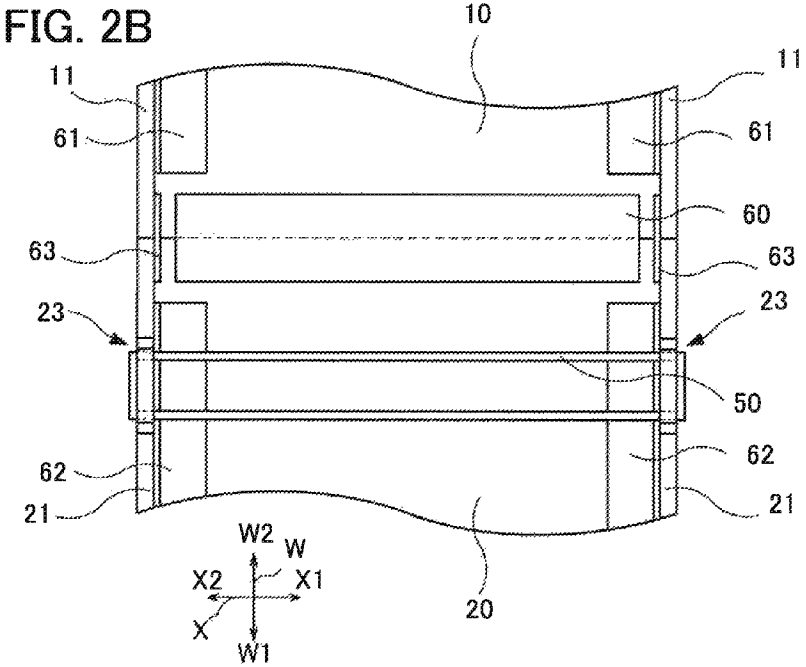

FIGS. 2A, 2B and 2C are cross-sectional views and a rear view of the autonomously standing display apparatus 1 in the autonomously standing state, according to the first embodiment.

FIG. 2A is a transverse sectional view of the autonomously standing display apparatus 1 (sectional view along a line 2*a*-2*a* of FIG. 1).

FIG. 2B is a diagram showing connections of a first display board 10, a first side plate 11, a second display board 20, and a second side plate 21, as viewed from a rear side. Note that an illustration of a support plate 40 is omitted in FIG. 2B.

FIG. 2C is a longitudinal sectional view of the autonomously standing display apparatus 1 (sectional view along a line 2*c*-2*c* of FIG. 1).

Figure 3:
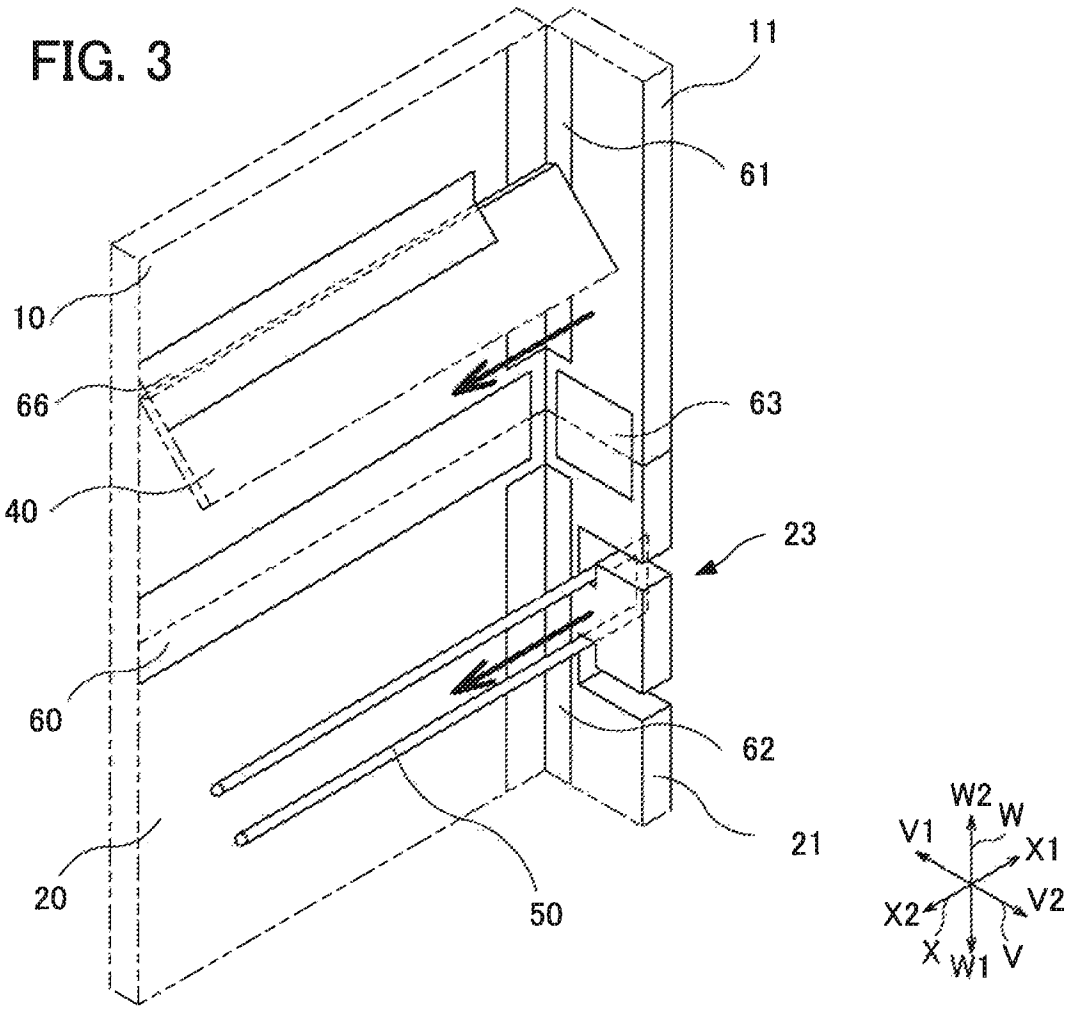
FIG. 3 is a perspective view illustrating a holding structure for a first display board 10, a first side plate 11, a second display board 20, and a second side plate 21, according to the first embodiment.

FIG. 3 is a perspective view illustrating a holding structure for the first display board 10, the first side plate 11, the second display board 20, and the second side plate 21, according to the first embodiment.

In the embodiment illustrated, the autonomously standing display apparatus 1 is installed as standing alone in a vertical direction Z, in which a horizontal direction is X, and a depth direction is Y. In order to clarify the corresponding relationships among the respective diagrams, the illustrations are provided with a VW coordinate system in an installed state, in which a coordinate W represents an in-plane vertical direction in relation to the first display board 10 and the second display board 20; and a coordinate V represents a normal direction in relation to surfaces of the first display board 10 and the second display board 20.

For the purpose of illustration, a front direction Y1 is illustrated as the front, and a back direction Y2 is illustrated as the back, as appropriate, based on the state shown in FIG. 1.

In-Use Configuration

An in-use configuration of the autonomously standing display apparatus 1 will now be described.

As shown in FIG. 1 and FIGS. 2A and 2B, the autonomously standing display apparatus 1 is provided with a display using, for example, print or the like on surfaces of the first display board 10 and the second display board 20. The intended use of the autonomously standing display apparatus 1 is, for example, a signboard or the like provided at a storefront of a shop, for displaying advertisement or the like (not illustrated). An overall height of the autonomously standing display apparatus 1 is, for example, about 300 mm to 2000 mm. Note that the intended use and the dimension of the autonomously standing display apparatus 1 are not limited thereto.

The autonomously standing display apparatus 1 is provided with the first display board 10, the first side plate 11, the second display board 20, the second side plate 21, a bottom plate 30, the support plate 40, a rubber 50 (biasing member), and hinges 60 to 66.

The first display board 10, the first side plate 11, the second display board 20, the second side plate 21, the bottom plate 30, and the support plate 40 are formed of a paper material, a resin plate, and a resin foam plate onto which a paper material is bonded, etc. Each of the plate members has sufficient strength to allow the autonomously standing display apparatus 1 to stand alone when installed.

The hinges 60 to 66 are each a plate element for allowing rotatable connection between the respective plate members. The hinges 60 to 66 are formed of a material such as paper and a resin sheet to which an adhesive tape is applied, such that the hinges 60 to 66 can be bonded to each plate member.

As shown in FIG. 1, the first display board 10 is a display board arranged in an, upper section.

The first side plate 11 is adjacently provided to each of right and left side edges of the first display board 10.

The second display board 20 is a display board arranged adjacently below the first display board 10.

The second side plate 21 is adjacently provided to each of right and left side edges of the second display board 20.

The bottom plate 30 is adjacently provided to lower edge of the second display plate 20.

The support plate 40 is adjacently provided to a deep edge of the bottom plate 30 with respect to the back direction Y2. Another edge of the support plate 40, which is opposite to the bottom plate 30, is attached to a back face of the first display board 10.

The rubber 50 is an elastic band (rubber band) for biasing the second side plate 21 inward in the horizontal direction X. The rubber 50 is hooked at a notch 23 of the second side plate 21. The rubber 50 biases two second side plates 21 so as to cause them to be pulled toward each other in the horizontal direction X, while the extended rubber contracts.

Note that the biasing member is not limited to the rubber 50, and may take any form as long as the member biases the second side plate 21 inward. For example, the biasing member may alternatively be a member such as a leaf spring, which is bent at 90 degrees and attached to an inside corner of the second display board 20 and the second side plate 21.

As shown in FIG. 2, the hinge 60 rotatably connects the first display board 10 and the second display board 20.

The hinge 61 rotatably connects the first display board 10 and the first side plate 11.

The hinge 62 rotatably connects the second display board 20 and the second side plate 21. The hinge 63 rotatably connects the first side plate 11 and the second side plate 21.

The hinge 64 rotatably connects the second display board 20 and the bottom plate 30.

The hinge 65 rotatably connects the bottom plate 30 and the support plate 40.

The hinge 66 rotatably connects the support plate 40 and the back face of the first display board 10.

In this manner, the autonomously standing display apparatus 1 is integrally formed by the hinges 60 to 66 which connect the plate members respectively. Therefore, once the hinges 60 to 66 and the rubber 50 are incorporated, the autonomously standing display apparatus 1 can be easily assembled without the need to incorporate any additional components.

Autonomously Standing Structure

An autonomously standing structure of the autonomously standing display apparatus 1 will now be described.

As shown in FIG. 2C, the partial first display board 10 (a portion between the hinge 60 and the hinge 66) and the second display board 20, the bottom plate 30, and the support plate 40 form respective sides of a triangle 70, thereby establishing an opened state. Here, if the first display board 10 and the second display board 20 rotate around the hinge 60, the triangle 70 changes into a quadrilateral 71 (see FIG. 5A) to cause autonomously standing to be no longer implemented. In this case, the autonomously standing display apparatus 1 will be folded.

Accordingly, the autonomously standing display apparatus 1 has the following function to keep autonomously standing, by protecting the first display board 10 and the second display board 20 from rotating.

(1) As shown in FIG. 3, the rubber 50 biases the second side plate 21 inward.

(2) Since the first side plate 11 and the second side plate 21 are connected by the hinge 63, the first side plate 11 is biased inward in conjunction with the second side plate 21. As a result, the first side plate 11 abuts on the support plate 40, and is maintained in an upstanding state in relation to the first display board 10; and the angle formed by the first side plate 11 and the first display board 10 is maintained at 90 degrees. At the same time, since the first side plate 11 and the second side plate 21 are connected by the hinge 63, the second side plate 21 is maintained in an upstanding state in relation to the second display board 20; and the angle formed by the second side plate 21 and the second display board 20 is maintained at 90 degrees.

In this manner, by way of a biasing force of the rubber 50 and a stopper function provided by the support plate 40, the first side plate 11 is maintained in the 90-degree upstanding state in relation to the first display board 10, and the second side plate 21 is maintained in the 90-degree upstanding state in relation to the second display board 20.

Note that the support plate 40 is configured to concurrently serve the stopper function and an inclination suppression function (to be described later).

(3) The angle formed by the first side plate 11 and the first display board 10 is maintained at 90 degrees; and the angle formed by the second side plate 21 and the second display board 20 is maintained at 90 degrees. Therefore, the first side plate 11 and the second side plate 21 integrally thrust the first display board 10 and the second display board 20, such that the first display board 10 and the second display board 20 are restricted from rotating around the hinge 60. As a result, the first display board 10 and the second display board 20 are maintained in a state of being deployed flat (at 180 degrees).

(4) An end face in a lower direction Z1 of the first side plate 11 is in planar contact with an end face in an upper direction Z2 of the second side plate 21 (see a contact face S1 shown in FIG. 1). Here, for example, if a force is applied from an upper end of the first side plate 11 in the lower direction Z1 (see an arrow F1 shown in FIG. 2), the force biases the first display board 10 to rotate in a back direction Y2 around the hinge 60. In this case, the planar contact face S1 restrains this rotation of the first display board 10.

Consequently, a portion of the first display board 10, the second display board 20, the bottom plate 30, and the support plate 40 maintain the triangle 70, which represents the opened state (see FIG. 2C). The autonomously standing display apparatus 1, in which the bottom plate 30 is set on a floor and the support plate 40 perform supporting, can maintain the autonomously standing state.

Folding from Autonomously Standing State to Folded State

Folding of the autonomously standing display apparatus 1 will now be described.

Figure 4B:
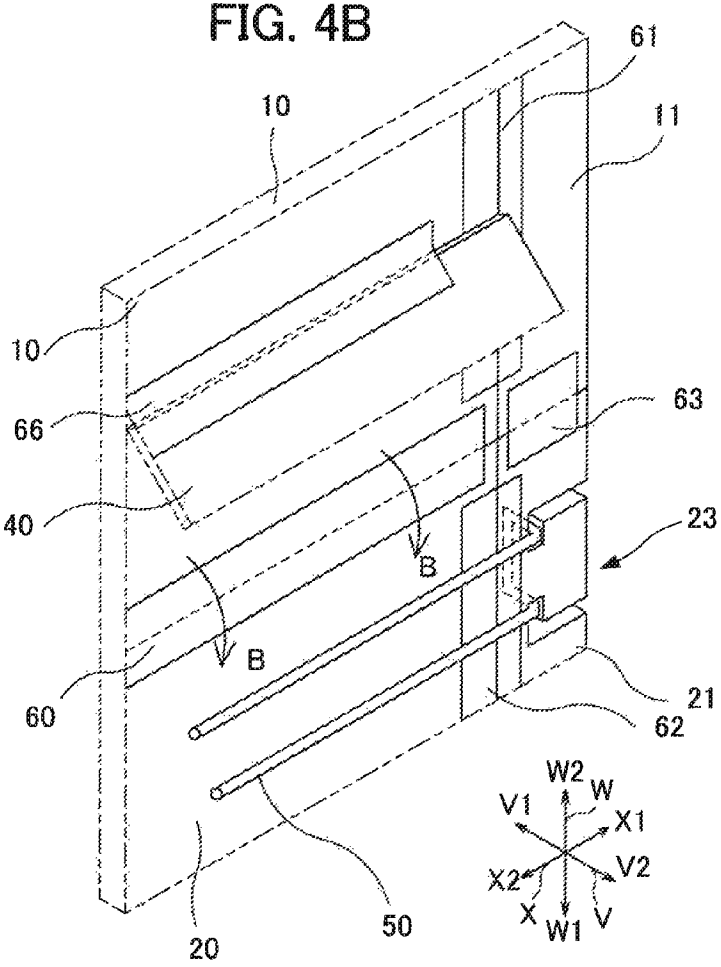
FIGS. 4A and 4B are each a perspective view illustrating a folding operation of the autonomously standing display apparatus 1 according to the first embodiment.
Figure 4A:
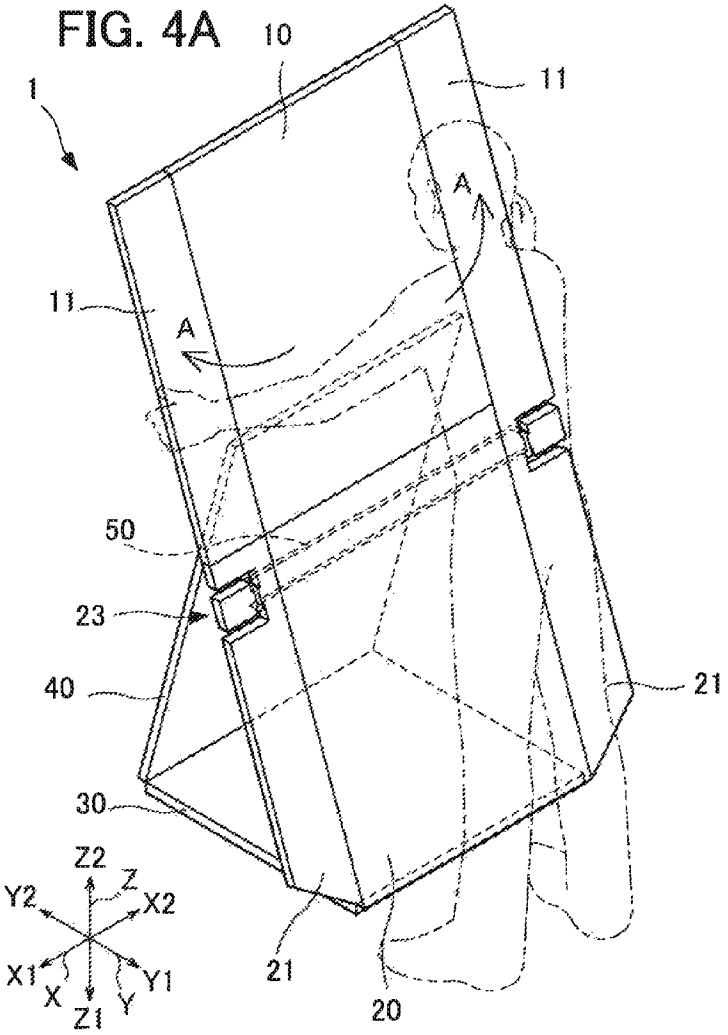

FIGS. 4A and 4B are each a perspective view illustrating a folding operation of the autonomously standing display apparatus 1 according to the first embodiment.

FIG. 4A is a perspective view of an entirety of the autonomously standing display apparatus 1.

FIG. 4B is an enlarged perspective view showing a rear face of the autonomously standing display apparatus 1.

Figure 5B:
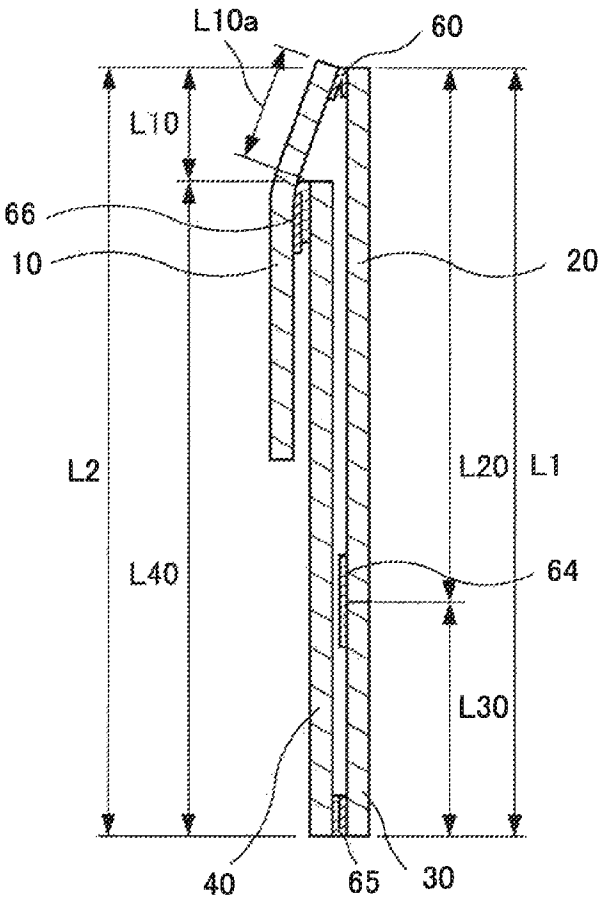
FIGS. 5A and 5B are each a longitudinal sectional view illustrating a folding state of the autonomously standing display apparatus 1 according to the first embodiment.
Figure 5A:
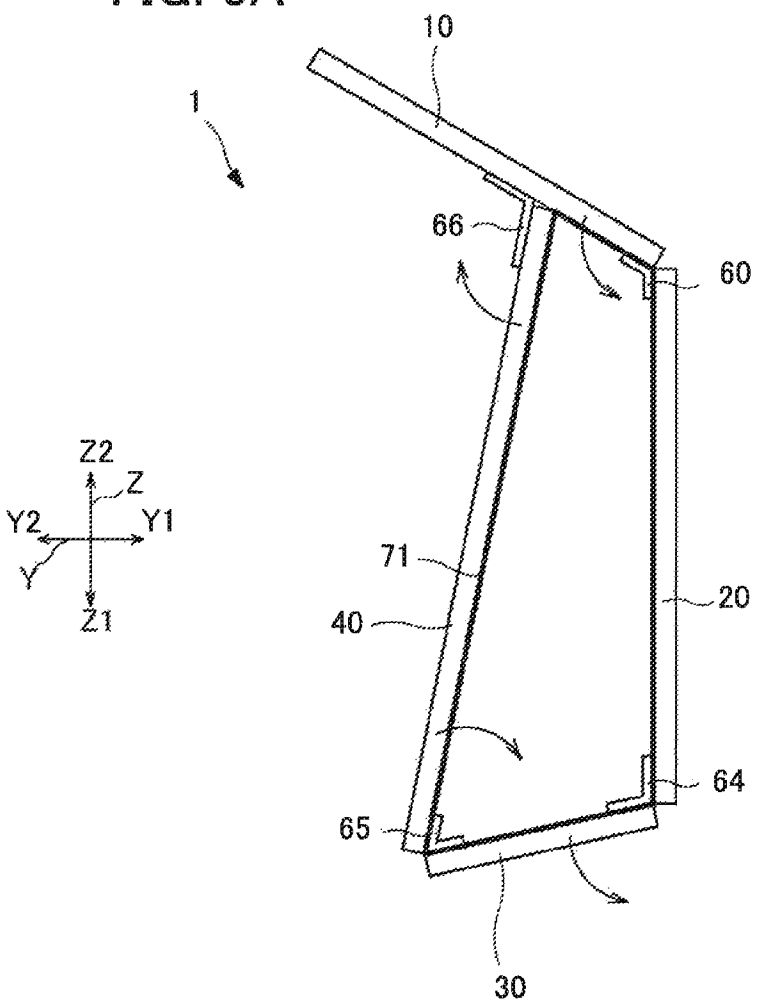

FIGS. 5A and 5B are each a longitudinal sectional view illustrating a folding state of the autonomously standing display apparatus 1 according to the first embodiment.

FIG. 5A is a diagram illustrating a folding operation of the autonomously standing display apparatus 1.

FIG. 5B is a diagram illustrating the autonomously standing display apparatus 1 folded flat.

Note that the cross section in FIG. 5B is hatched to clarify the cross-sectional shape.

Figure 6:
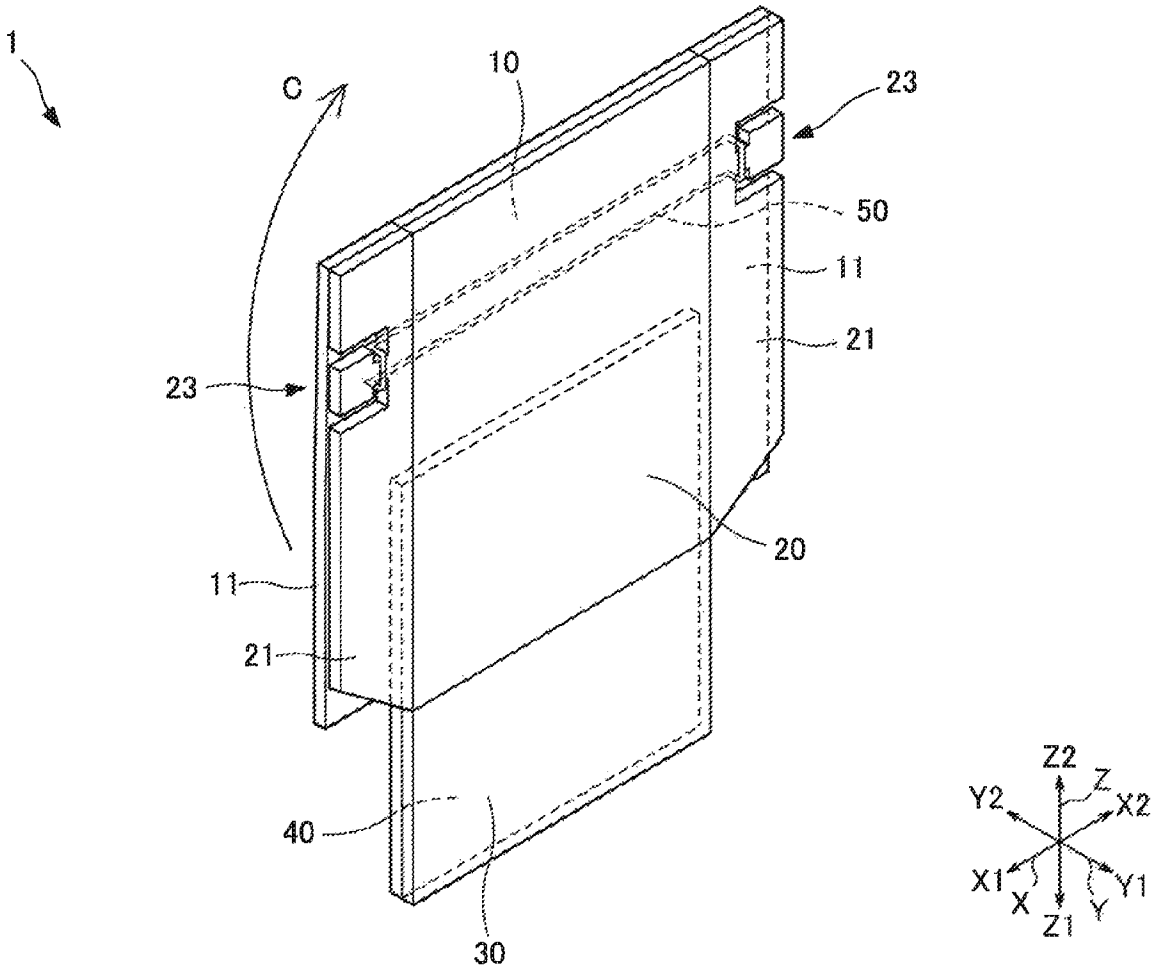
FIG. 6 is a perspective view illustrating the autonomously standing display apparatus 1 folded flat according to the first embodiment.

FIG. 6 is a perspective view illustrating the autonomously standing display apparatus 1 folded flat according to the first embodiment.

As described above, the first side plate 11 and the second side plate 21 are maintained in the upstanding state in relation to the first display board 10 and the second display board 20; as a result, the autonomously standing display apparatus 1 maintains the autonomously standing state. Therefore, a user (an assistant, etc. at a shop where the autonomously standing display apparatus 1 is installed) can fold the autonomously standing display apparatus 1, by rotating the first side plate 11 and the second side plate 21 so as to be folded from the upstanding state.

(1) As shown in FIG. 4A, the user rotates the first side plate 11 around the hinge 61 so as to expand it outward (see an arrow A). Since the first side plate 11 and the second side plate 21 are connected by the hinge 63, the second side plate 21 rotates in conjunction with the rotation of the first side plate 11. FIG. 4A illustrates an example to show rotation of the first side plate 11. Similarly, it may be possible that the second side plate 21 also is rotated to cause the first side plate 11 to rotate in conjunction therewith.

As shown in FIG. 4B, when the first side plate 11 and the second side plate 21 are rotated to be flat in relation to the first display board 10 and the second display board 20, the bracing function is lost. The first display board 10 and the second display board 20 are rotated and folded around the hinge 60 (see an arrow B).

(2) As shown in FIG. 5A, in conjunction with the rotation of the first display board 10 and the second display board 20, the second display board 20 and the bottom plate 30 are rotated and deployed flat around the hinge 64. The bottom plate 30 and the support plate 40 are rotated and folded around the hinge 65. The support plate 40 and the first display board 10 are rotated and folded around the hinge 66.

As a result, the first display board 10, the second display board 20, the bottom plate 30, and the support plate 40 can no longer maintain the shape of the triangle 70 of the opened state, and change into the quadrilateral 71.

(3) Eventually, as shown in FIGS. 5B and 6, the support plate 40 and the first display board 10 are folded to stick together in the closed state, and the entirety of the autonomously standing display apparatus 1 can be folded to be flat (note that FIG. SB is illustrated to have a gap between respective members, so as to distinguish each member). In FIG. 5B, the first display board 10 is illustrated in a manner of bending around the hinge 66 for the purpose of describing the sectional view, but the first display board 10 does not actually bend in the folded state.

Note that setting of dimensions for allowing the flattening in this manner will be described later.

In this manner, the autonomously standing display apparatus 1, which is foldable to be entirely flat, is compact for transportation and storage, and easy to handle.

Assembly from Folded State to Autonomously Standing State

Assembly of the autonomously standing display apparatus 1 will now be described.

In assembly of the autonomously standing display apparatus 1, the user follows steps reverse to the folding steps.

(1) As shown in FIG. 6, the user deploys the first display board 10 and the first side plate 11 as well as the second display board 20 and the second side plate 21 from the folded autonomously standing display apparatus 1 (see an arrow C).

(2) When the first display board 10 and the second display board 20 are deployed to about 90 degrees, the biasing force of the rubber 50 starts to work effectively, so that the second side plate 21 will stand up by itself. Since the first side plate 11 and the second side plate 21 are connected by the hinge 63, the first side plate 11 will stand up in relation to the first display board 10 in conjunction with the second side plate 21 (see FIG. 3).

(3) In conjunction with the upstanding of the first side plate 11 and the second side plate 21, the first display board 10 and the first side plate 11 as well as the second display board 20 and the second side plate 21 autonomously deploy to be flat (see FIG. 3). As a result, the first display board 10 and the second display board 20, the bottom plate 30, and the support plate 40 change from the closed state into the quadrilateral 71 (see FIG. 5A).

(4) When the first display board 10 and the first side plate 11 as well as the second display board 20 and the second side plate 21 flatly open, the biasing force of the rubber 50 causes the first side plate 11 and the second side plate 21 to abut on the support plate 40 to maintain the upstanding state at 90 degrees in relation to the first display board 10 and the second display board 20 (see FIG. 3). A portion of the first display board 10, the second display board 20, the bottom plate 30, and the support plate 40 form the triangle 70 of the opened state (see FIG. 2B); the autonomously standing display apparatus 1 is in the autonomously standing state; and the assembly is completed.

In this manner, the autonomously standing display apparatus 1 will autonomously stand up through the biasing force applied by the rubber 50. Therefore, the user hardly needs to apply a force, except for deploying the first display board 10 and the first side plate 11 as well as the second display board 20 and the second side plate 21 to about 90 degrees. In addition, since new components are not necessary to be incorporated as described above, it is possible for the user to easily assemble the autonomously standing display apparatus 1 even at a storefront of a shop, etc.

Dimension Setting

As shown in FIG. 5B, dimensions in the vertical direction Z viewed from side faces of respective members are set in the folded state, as described below. The dimensions are set to satisfy: length L1=length L2, where L20 is a length of the second display board 20;

L30 is a length of the bottom plate 30;

L40 is a length of the support plate 40;

L10 is a length between the hinge 66 (connection of the support plate 40 with the first display board 10) and the hinge 60 (connection of first display board 10 with the second display board 20);

length L1=L20+L30; and length L2=L40+L10.

In this manner, the autonomously standing display apparatus 1 can be folded flat in the closed state, since the corresponding members on the front and rear sides between the hinge 60 and the hinge 65 are set to be equal in length. In the opened state, the triangle 70 is formed, and the first display board 10 and the second display board 20 are deployed flat; therefore, the autonomously standing display apparatus 1 can stand autonomously.

Note that it may be set such that length L10=length L10*a*, since thicknesses of each plate member and each hinge are sufficiently thin.

As described above, the autonomously standing display apparatus 1 can be compactly folded, and can be easily assembled, since the parts count is low.

Example of Deployment View

Plate members to be assembled into the autonomously standing display apparatus 1 (autonomously standing display apparatuses 1A and 1B) will now be described. The plate members for the autonomously standing display apparatus 1 are seen as flat parts when the autonomously standing display apparatus 1 is flatly deployed. Note that shapes of the autonomously standing display apparatuses 1A and 1B are examples, and can be modified in various ways.

Figure 7:
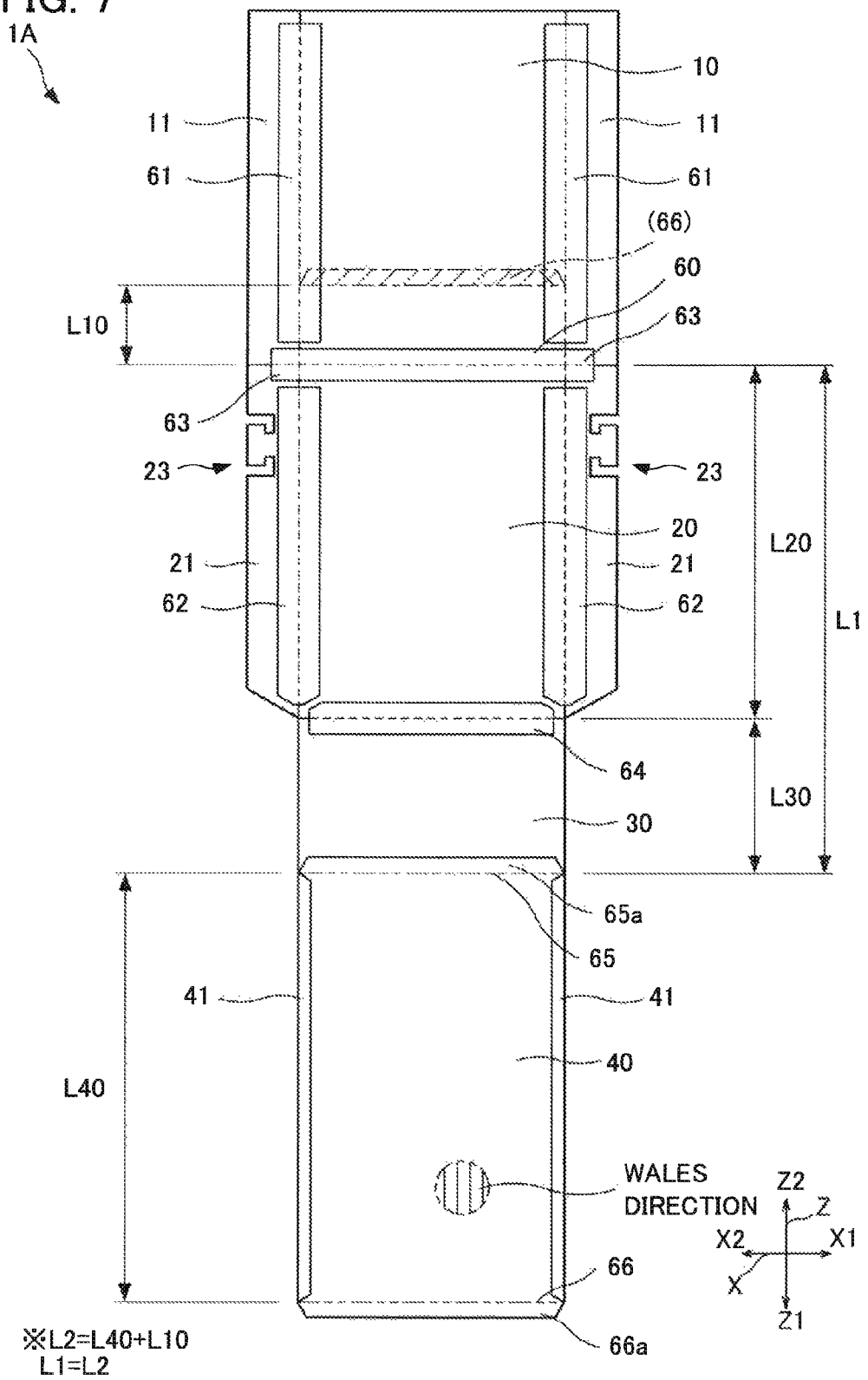
FIG. 7 is a diagram of a plate member of an autonomously standing display apparatus 1A according to the first embodiment, as viewed from a back side.

FIG. 7 is a diagram of plate members of the autonomously standing display apparatus 1A according to the first embodiment, as viewed from a back side.

Each plate member of the autonomously standing display apparatus 1A is described below.

An ethylene foam board (thickness t=5 mm), to the front and back of which a resin sheet is bonded, is used for each of the first display board 10, the first side plate 11, the second display board 20, the second side plate 21, and the bottom plate 30. A material allowing aesthetic design and having high strength is adoptable.

A corrugated fiberboard (BF) is used for the support plate 40. The material has been selected by focusing on low cost rather than an aesthetic point of view, since it is arranged on the back side. A hem 41 is provided to each of the right and left of the support plate 40, which is bent inward to improve the strength. Note that two sheets of corrugated fiberboard may be layered together for reinforcement if the strength is insufficient.

The support plate 40 is arranged, such that a wales direction is aligned with the vertical direction Z. The reason for this is to improve the strength in this direction to suppress inflection of the support plate 40, since a great force is often applied to each plate member in the vertical direction Z in the autonomously standing state or the like.

As the hinges 60 to 64, a resin sheet is bonded to each plate member with a double-sided tape. A single sheet material is used for both hinges 60 and 63.

With respect to the hinge 65, a hem 65*a* is provided to the support plate 40 through a ruled line (fold line), half-cut-off, etc. functioning as a hinge, which is shown as a two-dot chain line in the drawing. The hem 65*a* is bonded to the bottom plate 30.

With respect to the hinge 66, a hem 66*a* (connection) is provided to the support plate 40 through a ruled line, half-cut-off, etc. functioning as a hinge. The hem 66*a* is bonded to the back face of the first display board 10. Note that FIG. 7 is a deployment view in which the hem 66*a* is not bonded. As for the plate members, the autonomously standing display apparatus 1A is completed, when the hem 66*a* is bonded to a hatched portion of the back face of the first display board 10.

Figure 8:
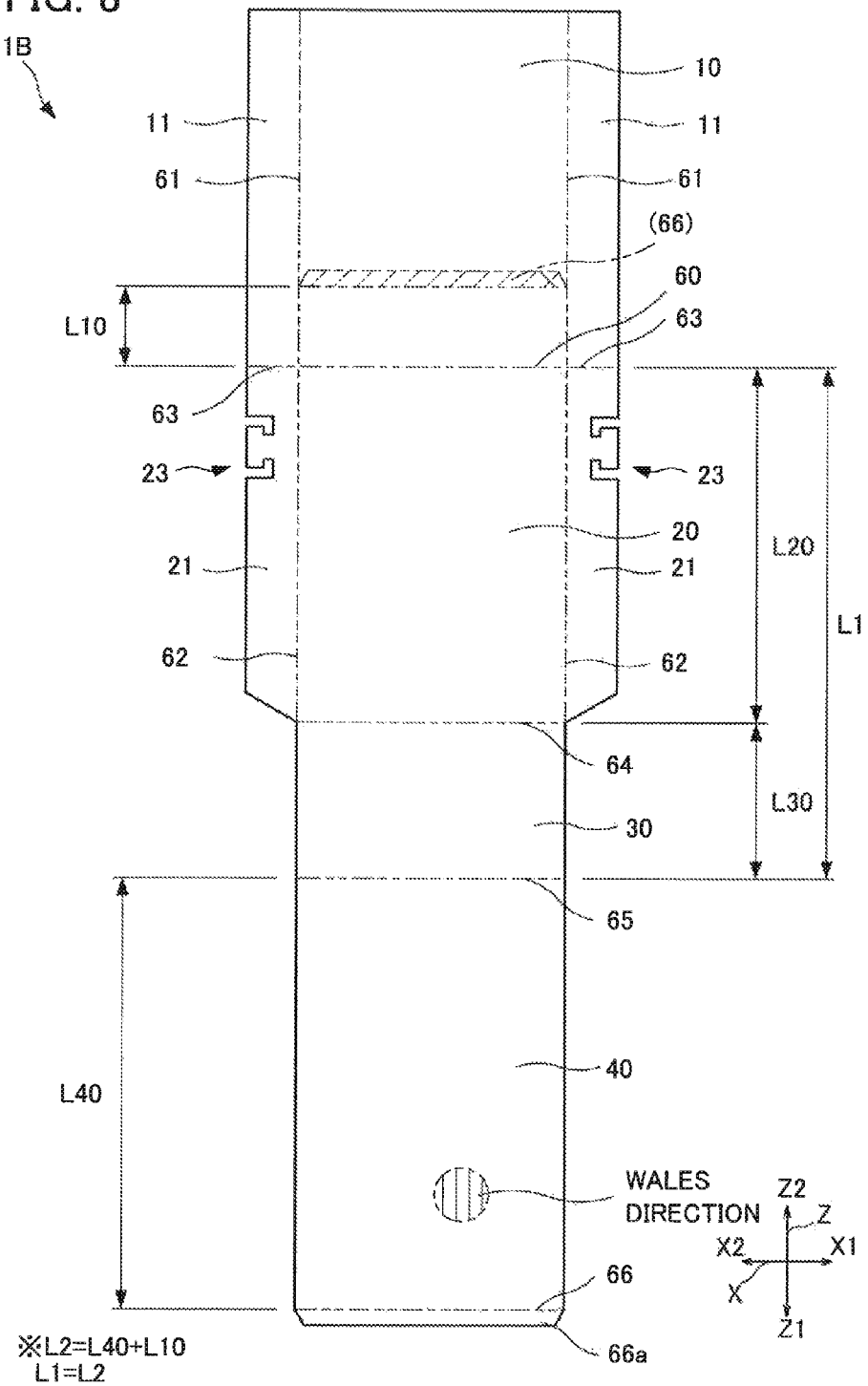
FIG. 8 is a diagram of a plate member of an autonomously standing display apparatus 1B according to the first embodiment, as viewed from a back side.

FIG. 8 is a diagram of plate members of an autonomously standing display apparatus 1B according to the first embodiment, as viewed from a back side.

The first display board 10, the first side plate 11, the second display board 20, the second side plate 21, the bottom plate 30, and the support plate 40 are integrally produced from a single sheet of corrugated fiberboard.

The hinges 60 to 65 are provided through a ruled line, half-cut-off, etc. functioning as the hinge between respective plate members.

With respect to the hinge 66, the hem 66*a* (connection) is provided to the support plate 40 through a ruled line, half-cut-off, etc. functioning as a hinge, similarly to the autonomously standing display apparatus 1B.

The autonomously standing display apparatus 1B, which is produced from a corrugated fiberboard, is suitable for a small-sized apparatus (for example, an overall height thereof in the installed state is about 300 mm), from a viewpoint of strength.

For the same reason as described above, it is arranged such that the wales direction is aligned with the vertical direction Z.

Second Embodiment

A description will be now made of a second embodiment of the present invention.

Note that, in the following descriptions and drawings, portions similar in function to the first embodiment are assigned with identical reference numerals (or reference numerals having identical last digits), and redundant descriptions are omitted as appropriate.

Figure 9B:
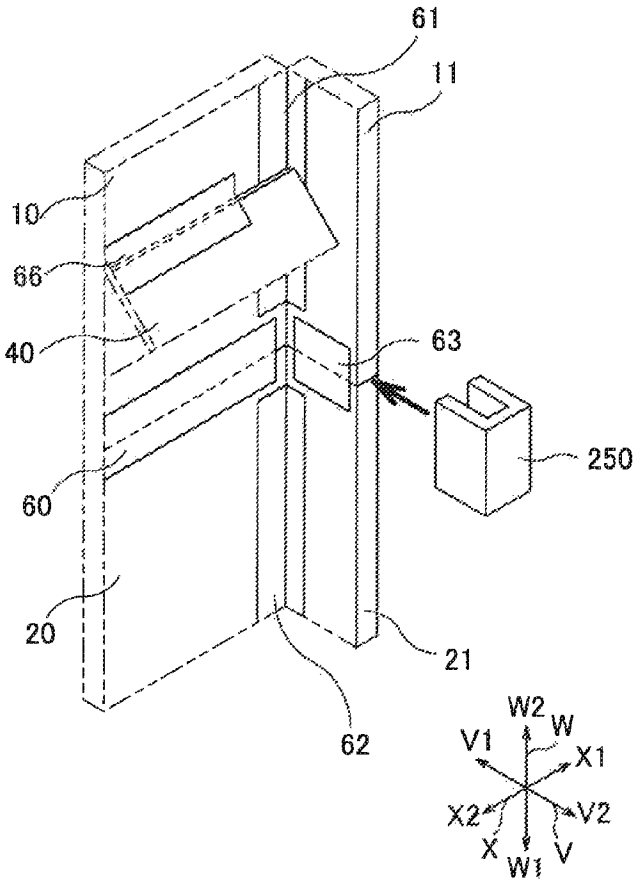
FIG. 9A is a perspective view of an autonomously standing display apparatus 201 in an autonomously standing state according to a second embodiment and FIG. 9B is a perspective view illustrating a holding structure therefor.
Figure 9A:
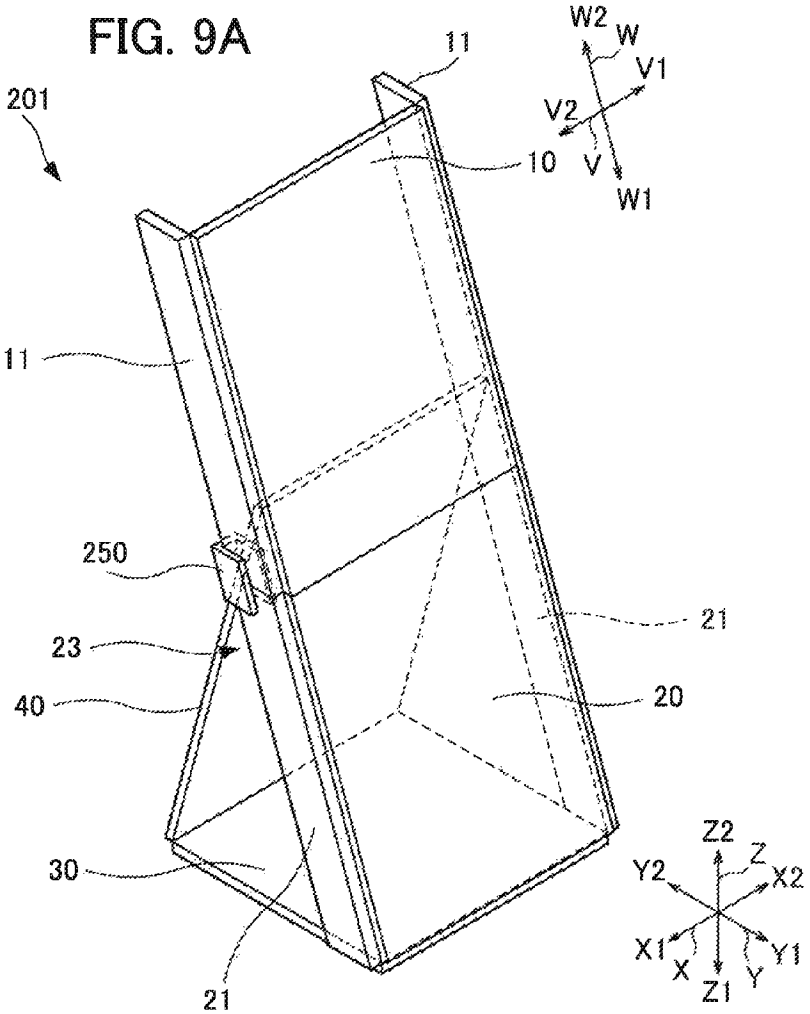

FIG. 9A is a perspective view of an autonomously standing display apparatus 201 in an autonomously standing state, according to a second embodiment; and FIG. 9B is a perspective view illustrating a holding structure therefor.

FIG. 9A is a perspective view of the autonomously standing display apparatus 201 in the autonomously standing state (this view corresponds to FIG. 1).

FIG. 9B is a perspective view illustrating a holding structure for a first display board 10, first side plate 11, second display board 20, and second side plate 21 (this view corresponds to FIG. 3).

The autonomously standing display apparatus 201 is provided with a clip 250 (holding member) in place of the rubber, in order to maintain the first display board 10 and the second display board 20 to deploy flat.

The clip 250 is a member, which is formed of a material such as resin or metal to have a U-shaped cross section. The clip 250 is formed to create a biasing force inward, such that a clipped member is pressed inside.

As shown in FIG. 9B, a user puts the clip 250 onto the first side plate 11 and the second side plate 21, in a state where the first display board 10 and the second display board 20 are deployed flat, and in a state where the first display board 10 and the second display board 20 maintain an angle of 90 degrees with respect to the first side plate 11 and the second side plate 21, respectively. As a result, the clip 250 can hold the first side plate 11 and the second side plate 21 so as not to be folded, and can hold the first display board 10 and the second display board 20 so as not to be folded.

Consequently, the autonomously standing display apparatus 201 can maintain the first display board 10 and the second display board 20 to deploy flat and stand autonomously, similarly to the first embodiment.

Note that the folding of the autonomously standing display apparatus 201 is similar to the folding in the first embodiment. Assembly of the autonomously standing display apparatus 201 is also similar to the assembly in the first embodiment, except that the biasing force by the rubber does not act thereon.

Third Embodiment

A description will be now made of a third embodiment of the present invention.

Figure 10:
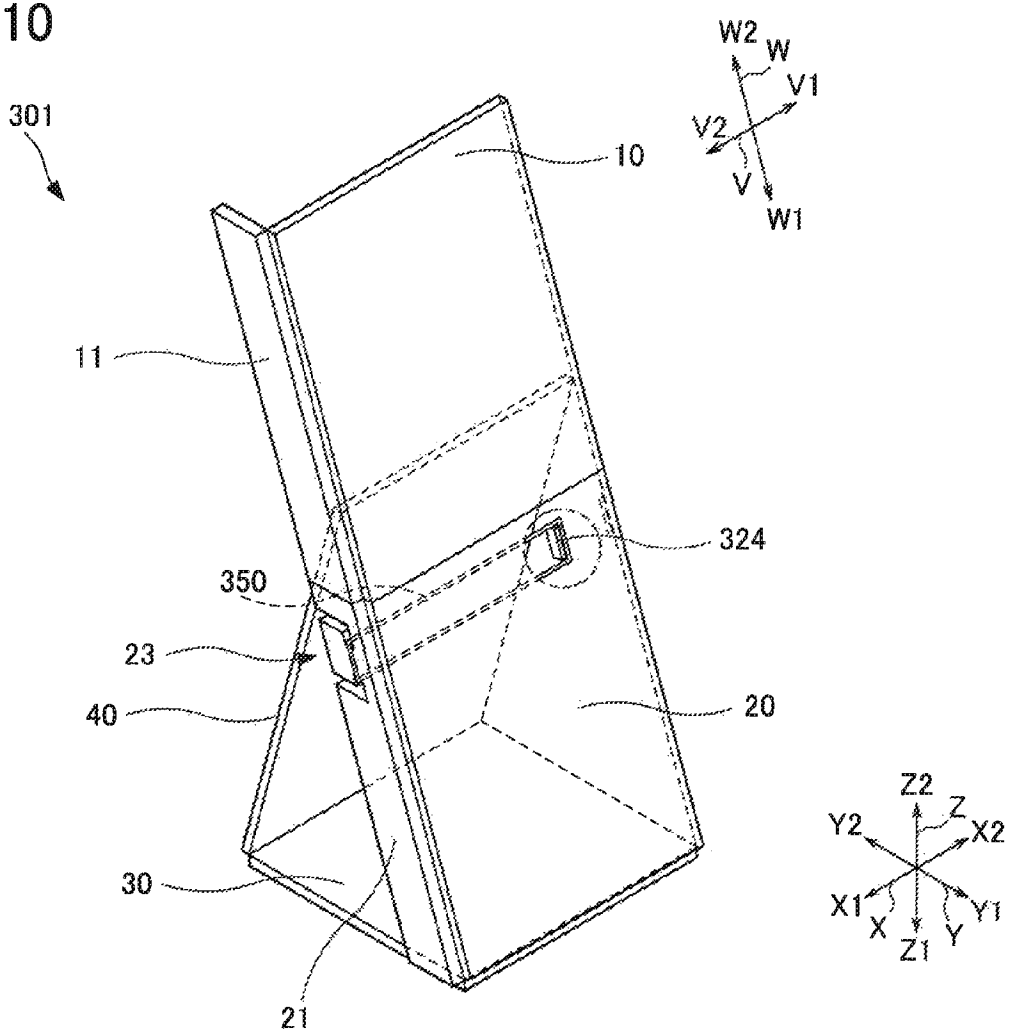
FIG. 10 is a perspective view of an autonomously standing display apparatus 301 in an autonomously standing state, according to a third embodiment.

FIG. 10 is a perspective view of an autonomously standing display apparatus 301 in an autonomously standing state, according to the third embodiment (this view corresponds to FIG. 1).

The autonomously standing display apparatus 301 is provided with a first side plate 11 and second side plate 21, only along one of side edges of a first display board 10 and second display board 20. One end of a rubber 350 on an opposite side of the first side plate 11 is hooked at a catch 324, which is provided on a back side of the second display board 20.

Even with such a configuration, the autonomously standing display apparatus 301 achieves effects similar to the effects of the first embodiment, since the rubber 350 biases the first side plate 11 and the second side plate 21 inward.

Fourth Embodiment

A description will be now made of a fourth embodiment of the present invention.

Figure 11:
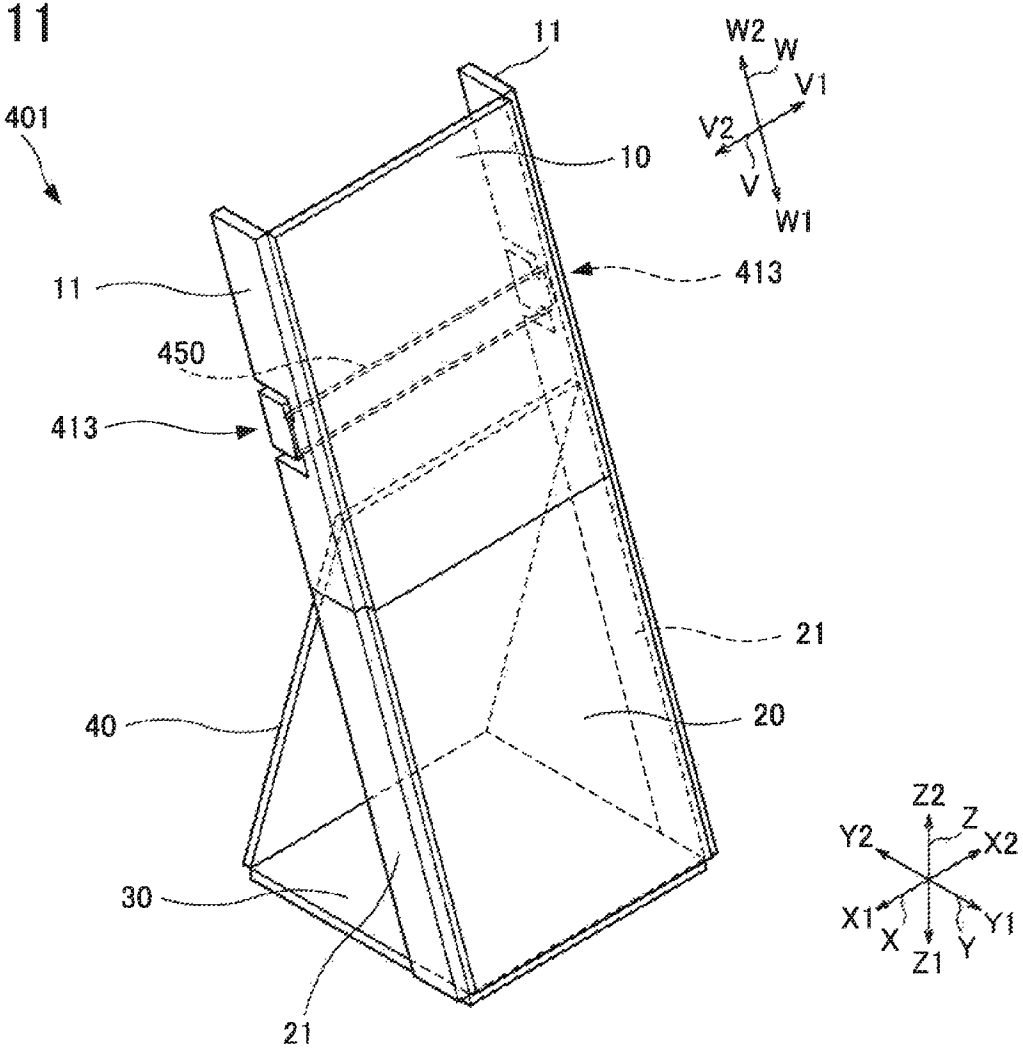
FIG. 11 is a perspective view of an autonomously standing display apparatus 401 in an autonomously standing state, according to a fourth embodiment.

FIG. 11 is a perspective view of an autonomously standing display apparatus 401 in an autonomously standing state, according to the fourth embodiment.

A rubber 450 of the autonomously standing display apparatus 401 is not hooked at a second side plate 21, but at a notch 413 of a first side plate 11.

Even in this case, the first side plate 11, which is biased inward and abuts on a support plate 40, is maintained in an upstanding state at 90 degrees in relation to the first display board 10. Since the first side plate 11 and the second side plate 21 are connected by a hinge 63 (see FIG. 3), the second side plate 21 is maintained in an upstanding state at 90 degrees in relation to a second display board 20.

Therefore, even if the rubber 450 is hooked at the first side plate 11, the autonomously standing display apparatus 401 can maintain the first display board 10 and the second display board 20 to deploy flat, and can maintain the autonomously standing state, similarly to the first embodiment.

The folding and assembly of the autonomously standing display apparatus 401 can be performed through collaboration of the first side plate 11 and the second side plate 21 connected by the hinge 63 (see FIG. 3) similarly with the first embodiment.

Fifth Embodiment

A description will be now made of a fifth embodiment of the present invention.

Figure 12:
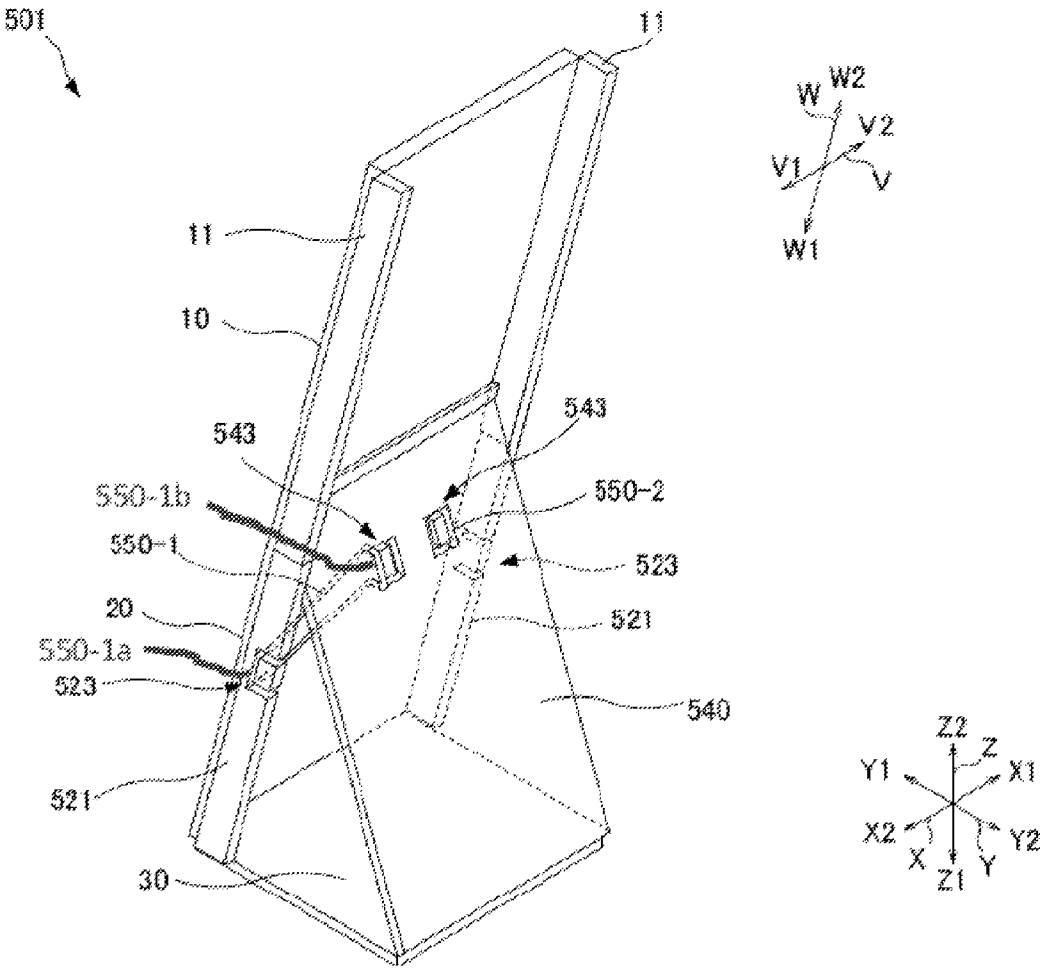
FIG. 12 is a perspective view of an autonomously standing display apparatus 501 in an autonomously standing state, according to a fifth embodiment, as viewed from a rear side.

FIG. 12 is a perspective view of an autonomously standing display apparatus 501 in an autonomously standing state, according to the fifth embodiment, as viewed from a back face.

In the autonomously standing display apparatus 501, rubbers 550 (550-1, 550-2) and their attachment structure are modified from the first embodiment.

As shown in FIG. 12, the autonomously standing display apparatus 501 is provided with the two rubbers 550 (550-1, 550-2) of elastic elements.

One end of the rubber 550-1 is hooked at a notch 523 of a second side plate 521, such that the one end is connected to the second side plate 521. The other end of the rubber 550-1 is connected to a notch 543 of a support plate 540.

In this manner, the rubber 550-1 is attached inside the autonomously standing display apparatus 501, such that the rubber 550-1 connects an inner surface of the second side plate 521 with an inner surface of the support plate 540.

With this configuration, the rubber 550-1 biases the second side plate 521 inward, so as to cause the second side plate 521 to stand up, similarly to the first embodiment. As a result, the autonomously standing display apparatus 501 can prevent a first display board 10 and second display board 20 from rotating and maintain the state of autonomous standing, similarly to the first embodiment.

Note that the rubber 550-2 and its attachment structure are symmetrical and similar to the rubber 550-1 and its structure (an illustration of the rubber 550-2 (dotted line) inside the autonomously standing display apparatus 501 is omitted in FIG. 12).

In this manner, since the support plate 540 is provided with the notches 543 for attaching the rubbers 550-1 and 550-2 in the autonomously standing display apparatus 501, the rubbers 550-1 and 550-2 can be attached without restriction resulting from a dimension of the support plate 540 in the horizontal direction X. This is because positions of the notches 523 and 543 may be arranged in conformity with dimensions of the rubbers 550-1 and 550-2.

Even if there are a plurality of autonomously standing display apparatuses 501 having different dimensions in the horizontal direction X, it is possible to control amounts of forces biasing second side plates 521 inward to be the same, as long as the positional relationship between a notch 523 of a second side plate 521 and a notch 543 of a support plate 540 is maintained the same. For a case where the plurality of autonomously standing display apparatuses 501 having different dimensions in the horizontal direction are designed and manufactured, it is not necessary to determine the positional relationship between the notch 523 of the second side plate 521 and the notch 543 of the support plate 540 on a custom-made basis for each apparatus. In addition, it is possible to use rubbers of the same dimension and strength.

Figures 13A, 13B, 13C:
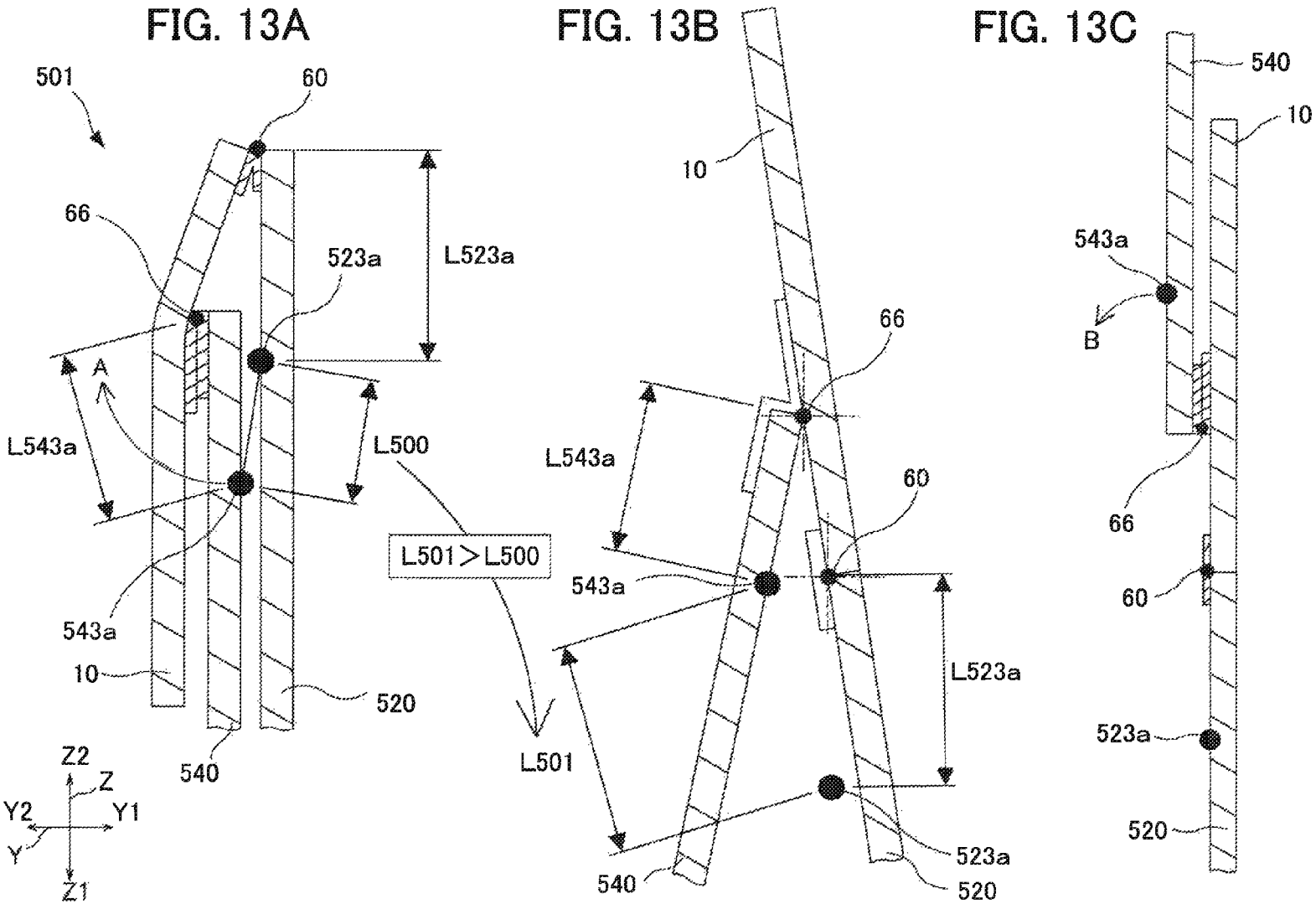
FIGS. 13A, 13B and 13C are each a sectional view of a part of the autonomously standing display apparatus 501 according to the fifth embodiment.

FIGS. 13A-13C are each a sectional view of a part of the autonomously standing display apparatus 501 according to the fifth embodiment.

FIG. 13A is a sectional view of the autonomously standing display apparatus 501, which is folded flat.

FIG. 13B is a sectional view of the autonomously standing display apparatus 501 in an opened state.

FIG. 13C is a sectional view illustrating movement of a dot 543*a* in a transition from the state of FIG. 13A to the state of FIG. 13B.

A dot 523*a* in FIGS. 13A-13C shows a position of the notch 523 of the second side plate 521. The dot 543*a* shows a position of the notch 543 of the support plate 540.

A description is now provided for movement of the dots 523*a* and 543*a*, when the autonomously standing display apparatus 501 changes from the flat-folded state to the opened state.

The dot 523*a* rotates around the hinge 60. Therefore, a length L523*a* between the dot 523*a* and the rotational center of the hinge 60 is maintained constant. As a result, the dot 523*a* moves from one position in FIG. 13A to another position in FIG. 13B.

In FIG. 13B, the second side plate 521 actually stands up to vary the distance between the dot 523*a* and the hinge 60; however, it is assumed that the variation is sufficiently small.

Meanwhile, the dot 543*a* rotates around the hinge 66. Therefore, a length L543*a* between the dot 543*a* and the rotational center of the hinge 66 is maintained constant. As a result, the dot 543*a* moves from one position in FIG. 13A to another position in FIG. 13B.

Here, the movement of the dot 543*a* is described separately for the case of rotation around the hinge 60 and the case of rotation around the hinge 66, when the autonomously standing display apparatus 501 changes from the state in FIG. 13A to the state in FIG. 13B. The autonomously standing display apparatus 501 does not actually take the state in FIG. 13C, which is however illustrated for the purpose of illustrating the movement of the dot 543*a*.

Rotation Around Hinge 60

The first display board 10 and the second display board 520 relatively rotate approximately 180 degrees around the hinge 60, and the dot 543*a* accordingly moves away from the dot 523*a* (see an arrow A). In this manner, the autonomously standing display apparatus 501 changes from the state in FIG. 13A to the state in FIG. 13C.

Rotation Around Hinge 66

From the state in FIG. 13C, the first display board 10 and the support plate 540 relatively rotate around the hinge 66 and the dot 543*a* moves to approach the dot 523*a* (see an arrow B), accordingly.

In this case, the dots 523*a* and 543*a* satisfy a condition that the distance moved according to the arrow A is greater than the distance moved according to the arrow B; as a result, a length L501 between the dots 523*a* and 543*a* is greater than a length L500 therebetween before the transition (L501>L500). In other words, the length between the dots 523*a* and 543*a* increases.

Note that the placement of the dots 523*a* and 543*a*, i.e. the placement of the notches 523 and 543, for satisfying the above condition, can be set appropriately in accordance with the placement of the hinges 60 and 66, etc. FIGS. 13A-13C are an example thereof. In FIG. 13A, the first display board 10 does not actually bend in the folded state for the same reasons as described for FIG. 5B.

Therefore, when the autonomously standing display apparatus 501 changes from the folded state to the opened state, the rubber 550 will further draw the second side plate 521 inward by a force resulting from an increase in the length between the dots 523*a* and 543*a* in addition to the previous biasing force. As a result, the rubber 550 can more reliably cause the second side plate 521 to stand up.

Even if the rubber is too stretched to obtain a sufficient biasing force, the second side plate 521 can stand up by the effect that the length L500 increases to the length L501 in the opened state.

Since the autonomously standing display apparatus 501 causes the second side plate 521 to reliably stand up as described above, it is possible to increase the reliability in assembling the autonomously standing display apparatus 501 by changing it from the folded state to the opened state.

Figure 19:
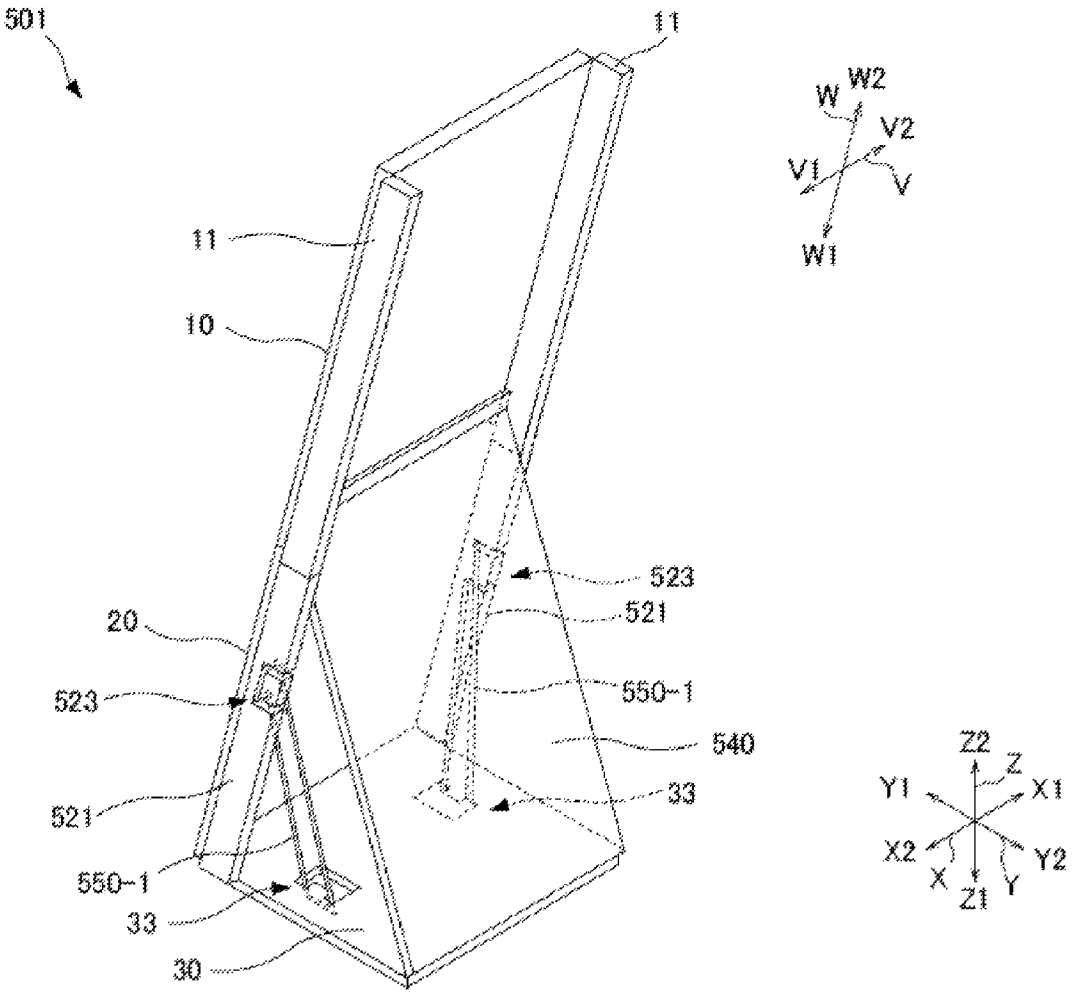
FIG. 19 is a perspective view of the autonomously standing display apparatus 501 in an autonomously standing state according to a fifth embodiment as viewed from a rear side.

Note that one end of the rubber 550 (550-1, 550-2) may be alternatively attached to a notch provided to the first side plate 11 instead of the second side plate 521. The other end of rubber 550 (550-1, 550-2) may alternatively be attached to a notch (33) provided to the bottom plate 30 (see e.g., FIG. 19) instead of the support plate 540.

In this case as well, the aforementioned effects are achieved by setting the interval between the notches to increase in the opened state.

Sixth Embodiment

A description will be now made of a sixth embodiment of the present invention.

Figures 14A, 14B:
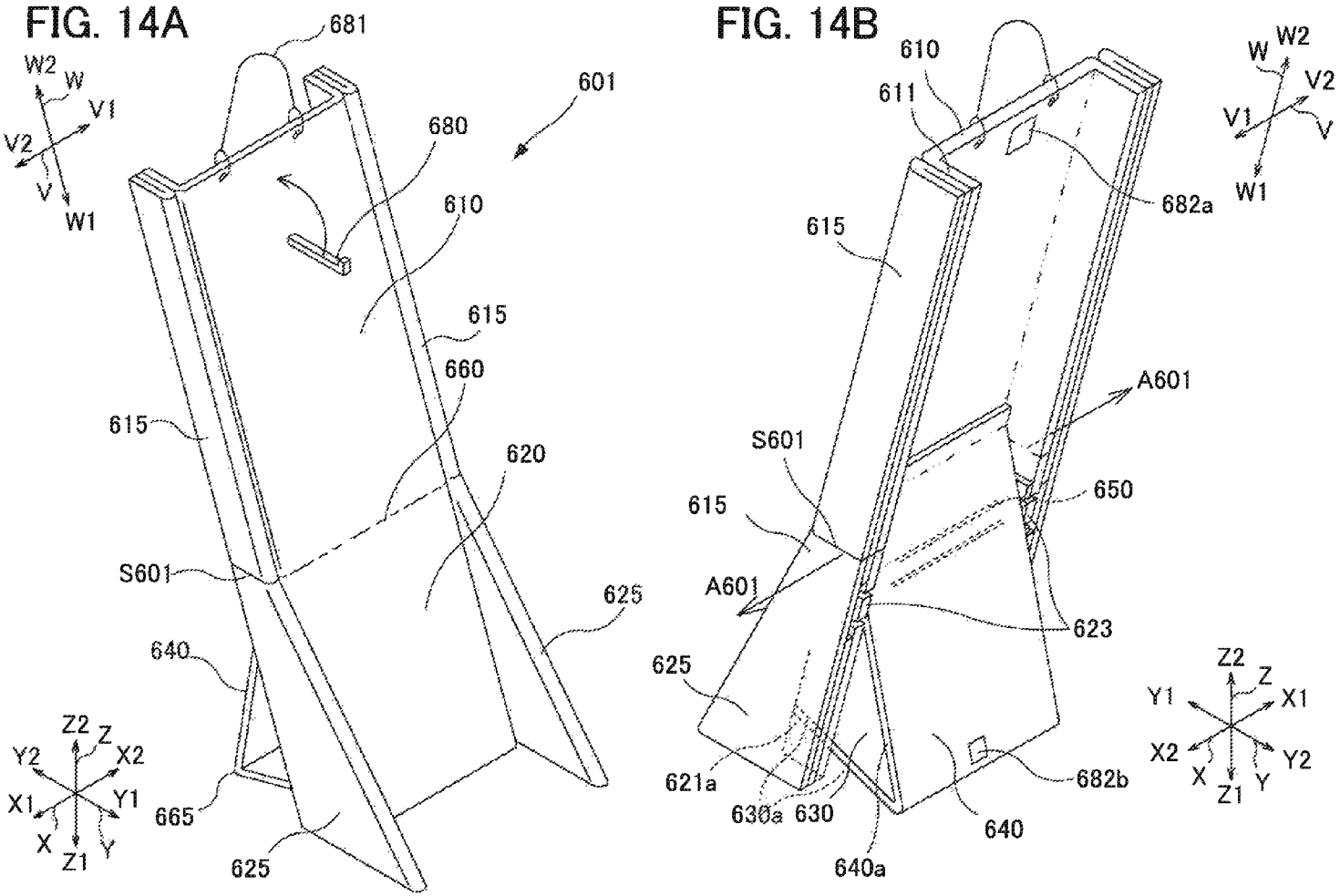
FIGS. 14A and 14B are each a perspective view of an autonomously standing display apparatus 601 in a autonomously standing state, according to a sixth embodiment.

FIGS. 14A and 14B are each a perspective view of an autonomously standing display apparatus 601 in an autonomously standing state according to the sixth embodiment.

FIG. 14A is a perspective view from a front face (front side Y1).

FIG. 14B is a perspective view from a back face (back side Y2).

Figure 15:
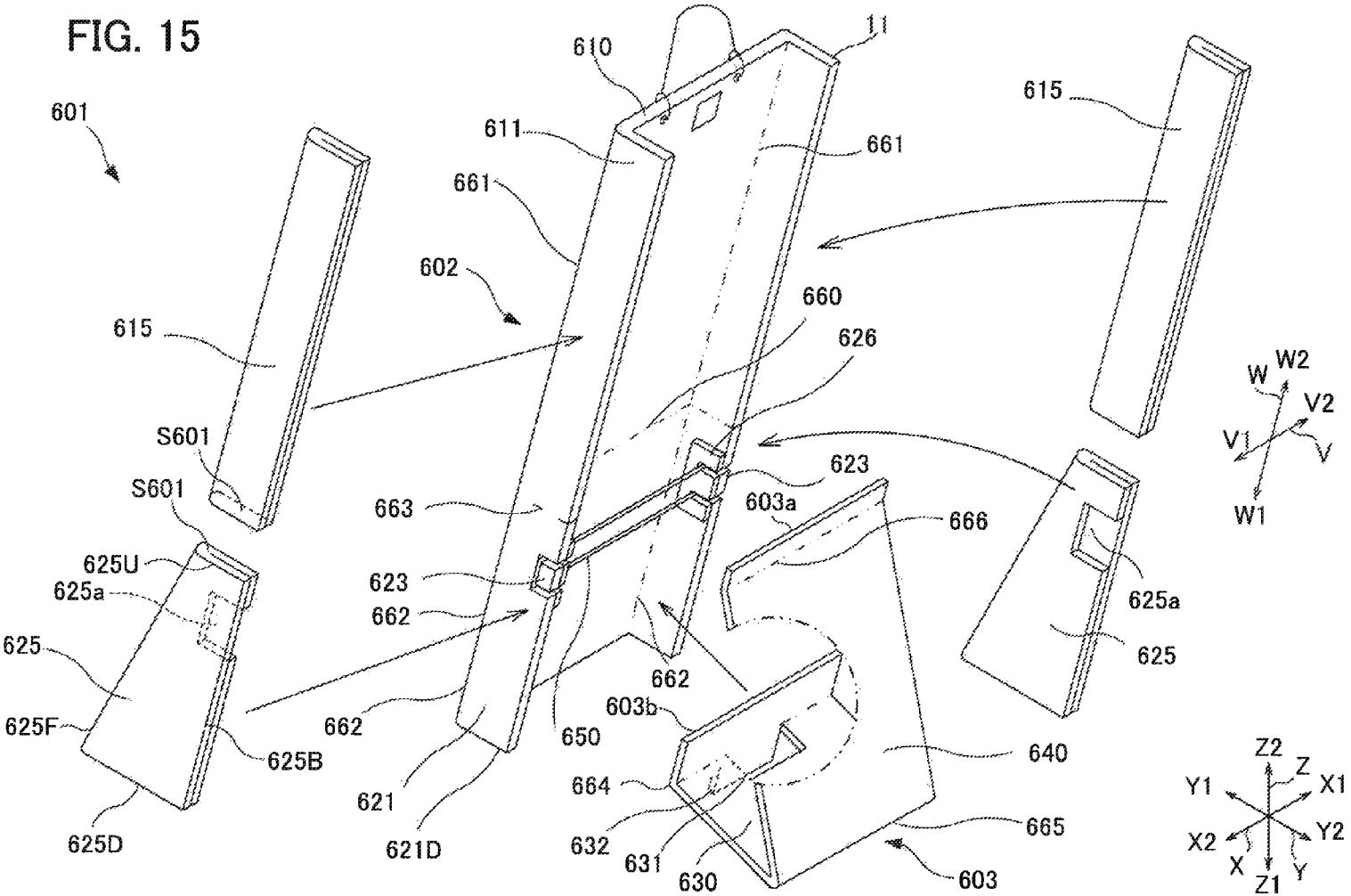
FIG. 15 is an exploded perspective view of the autonomously standing display apparatus 601 according to the sixth embodiment, as viewed from a rear side.

FIG. 15 is an exploded perspective view of the autonomously standing display apparatus 601 according to the sixth embodiment, as viewed from the back face.

Note that two-dot chain lines in FIGS. 14A-14B and 15 show flexure lines, as appropriate.

Configuration of Autonomously Standing Display Apparatus 601 A first display board 610, a first side plate 611, a second display board 620, and a second side plate 621 are formed of a single sheet of a corrugated fiberboard 602. Each connection between the plates is provided with a flexure line, which is a fold line. Flexure lines function as hinges 660, 662 and 663.

A bottom plate 630 and a support plate 640 are formed of a single sheet of a corrugated fiberboard 603. The corrugated fiberboard 603 is provided with hinges 664, 665 and 666, which are flexure lines, similarly to the corrugated fiberboard 602.

The corrugated fiberboard 602 is connected to the corrugated fiberboard 603 by an adhesive or the like by using glue margins 603*a* and 603*b* of the corrugated fiberboard 603.

When viewed from a horizontal direction X, a rubber attachment portion 623 of the second side plate 621 is arranged at a position intersecting the support plate 640. As a result, the rubber attachment portion 623 is biased inward by a rubber 650, and abuts on an external end face 640*a* of the support plate 640. Note that the rubber attachment portion 623 refers to a portion of the second side plate 621, to which a biasing force exerted by the rubber 650 is applied. In the present embodiment, the rubber attachment portion 623 is a portion interposed by notches for attachment.

Figure 16B:
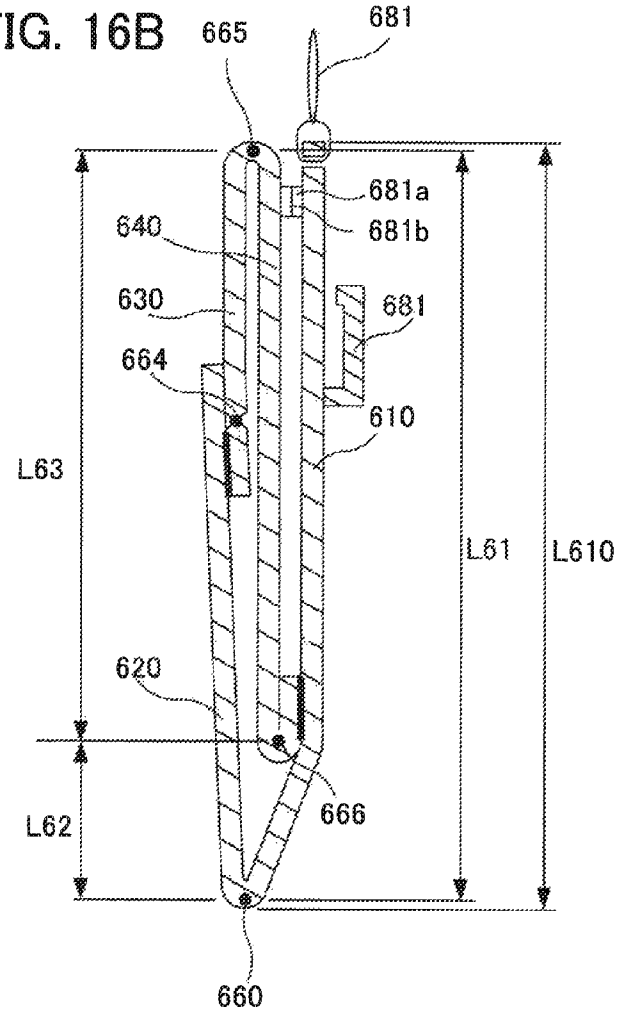
FIGS. 16A and 16B are each a sectional view of the autonomously standing display apparatus 601 according to the sixth embodiment, as viewed from a horizontal direction X.
Figure 16A:
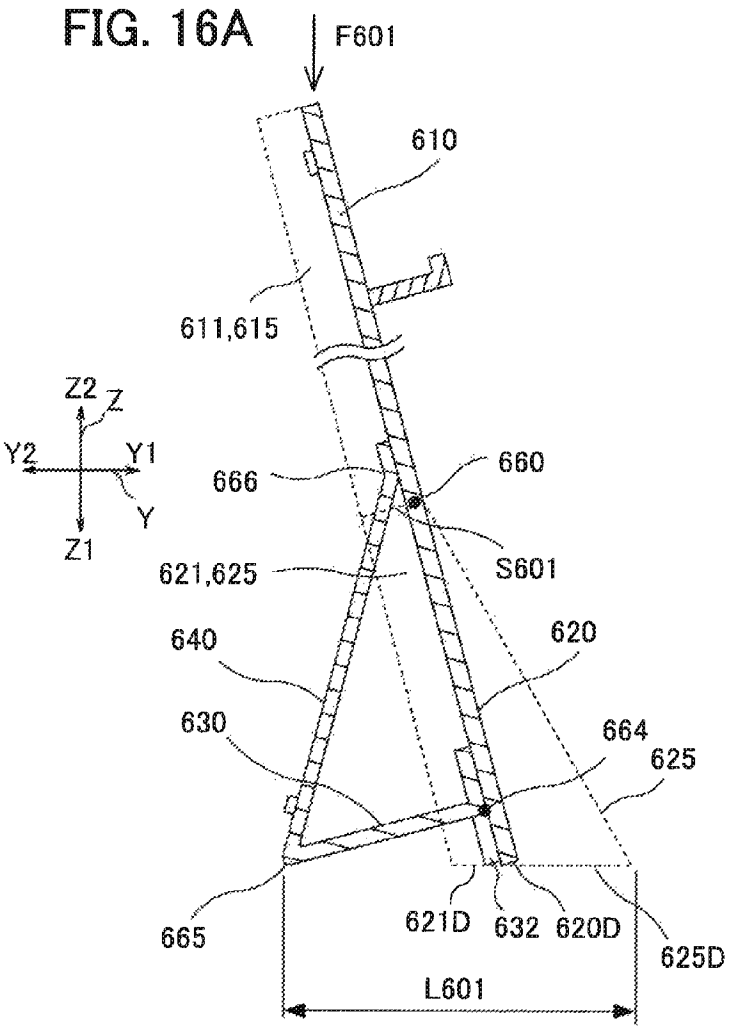

The bottom plate 630 is attached such that the hinge 664 is located higher in an upper direction Z2 than a lower end 620D of the second display board 620 (see FIG. 16A).

The bottom plate 630 includes an incision 631. When the glue margin 603*b* is bent along the hinge 664, an interior portion 632 of the incision 631 stands up in a lower direction Z1. A lower end of the interior portion 632 is used as a reference for positioning, when it is bonded to the second display board 620 in a manufacturing process (see FIG. 16A). In other words, a user may bond the bottom plate 630 to the second display board 620, such that the lower end of the interior portion 632 coincides with the lower end 620D of the second display board 620.

The first side plate 611 is provided with a side face reinforcing plate 615. The second side plate 621 is provided with a foot plate 625 (foot part). The rubber attachment portion 623 of the second side plate 621 is provided with a rubber attachment portion reinforcing plate 626. The autonomously standing display apparatus 601 is provided with a hook 680, a strap 681, and a pair of hook and loop fasteners 682*a* and 682*b*.

The side face reinforcing plate 615 and the foot plate 625, which are each double layered sheets formed by folding a single sheet of corrugated fiberboard in two, have sufficient strength.

The side face reinforcing plate 615 is bonded to the first side plate 611. An entire outer surface of the first side plate 611 is bonded to an entire inner surface of the side face reinforcing plate 615 by an adhesive or the like. When viewed from a horizontal direction X, an external shape of the side face reinforcing plate 615 is equal to an external shape of the first side plate 611.

The foot plate 625 is bonded to the second side plate 621. An entire outer surface of the second side plate 621 is bonded to an entire inner surface of the foot plate 625 by an adhesive or the like.

When viewed from the horizontal direction X, an external shape of the foot plate 625 is quadrilateral. An edge 625U at an upside of the foot plate 625 in the upper direction Z2 and an edge 625B thereof in a back direction Y2 coincide with corresponding edges of the second side plate 621, respectively.

A lower edge 625D of the foot plate 625 is shaped like an extension of a lower edge 621D of the second side plate 621 in a front direction Y1.

An edge 625F in the front direction Y1 is an oblique side which projects more in the front direction Y1 as it approaches in the lower direction Z1, such that the edge 625F is located at a front side of a display surface (a face in the front direction Y1) of the second display board 620.

On an inner side of the foot plate 625, a clearance 625*a* for the rubber 650 is provided in a region corresponding to the rubber attachment portion 623. The clearance 625*a* accepts the rubber 650 protruding outward from a side face of the second side plate 621.

The rubber attachment portion reinforcing plate 626 is a reinforcing plate for preventing the rubber attachment portion 623 from bending due to the biasing force of the rubber 650. The rubber attachment portion reinforcing plate 626 is bonded to an inner side of the second side plate 621.

A hook 680 is provided on a surface of the first display board 610. The hook 680 is provided with a hinge (not illustrated) on its root, so as to be rotatable in the upper direction Z2. When the autonomously standing display apparatus 601 is transported or stored, the user can compactly fold the autonomously standing display apparatus 601 by rotating the hook 680.

The strap 681 is provided at an upper portion of the first display board 610 in the upper direction 22.

As shown in FIG. 14B, one of the pair of hook and loop fasteners 682*a* is provided on a back face of the first display board 610 and the other of the pair of hook and loop fasteners 682*b* is provided on a back face of the support plate 640 (a face seeing in the back direction Y2).

An autonomously standing state and a folded state of the autonomously standing display apparatus 601 are described.

FIGS. 16A and 16B are each a sectional view of the autonomously standing display apparatus 601 according to the sixth embodiment, as viewed from the horizontal direction X.

FIG. 16A is a sectional view of the autonomously standing state.

FIG. 16B is a sectional view of a flat-folded state.

Figure 17:
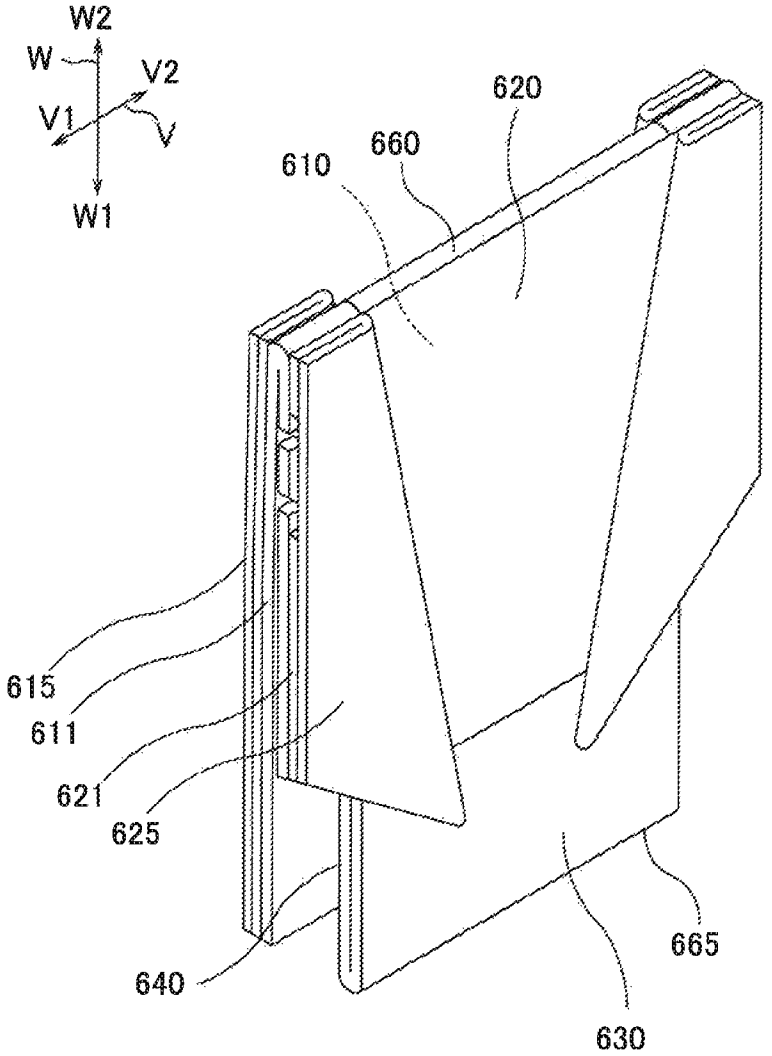
FIG. 17 is a perspective view of the autonomously standing display apparatus 601 folded flat according to the sixth embodiment.

FIG. 17 is a perspective view of the autonomously standing display apparatus 601 folded flat according to the sixth embodiment.

Dotted lines in FIG. 16A show the side face reinforcing plate 615, the foot plate 625, etc.

Autonomously Standing State At first, an autonomously standing state of the autonomously standing display apparatus 601 is described.

The autonomously standing display apparatus 601 of the present embodiment differs mainly in the following points from the aforementioned embodiments.

(1) As shown in FIG. 16A, the lower edge 625D of the foot plate 625, which is shaped like the extension of the lower edge 621D of the second side plate 621 in the front direction Y1, comes in contact with a surface of an installation spot. The hinge 665 between the support plate 640 and the bottom plate 630 also comes in contact with the surface of the installation spot.

As a result, the grounded portion of the foot plate 625 protrudes in the front direction Y1 in front of the second display board 620, and develops resistance to falling in the front direction Y1. Therefore, even if an article, a sample or the like is hung on the hook 680, the autonomously standing display apparatus 601 can stably maintain standing.

Since a length L601 between the grounded portion in the front direction Y1 and the grounded portion in the back direction Y2 is longer than that of the above-mentioned embodiments, the autonomously standing display apparatus 601 can also improve the stability against the swinging.

(2) As shown in FIGS. 14A and 15, the end face of the side face reinforcing plate 615 in the lower direction Z1 is in planar contact with the end face of the foot plate 625 in the upper direction Z2 at a contact face S601. Since the side face reinforcing plate 615 and the foot plate 625 are each two-fold thick, the area of the contact face S601 is sufficiently large.

As a result, as shown in FIG. 16A, even if a force in the lower direction Z1 is applied from the upper end of the first side plate 611 (see an arrow F601), the planar contact at the contact face S601 is stable and can improve the strength against rotation due to the force.

(3) As shown in FIG. 14B, in a case such as the above-mentioned case (2), the contact face S601, i.e. the portion in the vicinity of the hinge 663 is likely to escape outward and to alter in shape to bulge (see an arrow A601). Even in such a case, since the side face reinforcing plate 615 and the foot plate 625 are two-fold thick, the first side plate 611 and the second side plate 621 have sufficient strength as a whole. As a result, the autonomously standing display apparatus 601 can improve the strength against such a change in shape.

(4) As shown in FIG. 16A, the second display board 620 protrudes in the lower direction Z1 beyond the bottom plate 630 on a side of the front direction Y1. Therefore, the bottom plate 630, which is grounded at the hinge 665, is arranged obliquely more upward in the upper direction Z2 and the front direction Y1. Therefore, as shown in FIG. 14B, when the rubber 650 biases the second side plate 621 inward, an inner face 621*a* of the second side plate 621 reliably abuts on an outer end face 630*a* of the bottom plate 630.

As described above, the rubber attachment portion 623 (more precisely, the rubber attachment portion reinforcing plate 626) of the second side plate 621 is biased inward by the rubber 650, and abuts on the external end face 640*a* of the support plate 640.

Therefore, the bottom plate 630 and the support plate 640 restrict the second side plate 621 from further rotating inward. As a result, the second side plate 621 can maintain a stable angle of its upstanding from the second display board 620. Accordingly, in relation to the above-mentioned (2), the second side plate 621 can stably receive the contact face S601 of the first side plate 611 in the lower direction Z1. Since the second side plate 621 is restricted from changing shape inward, it can be suppressed from transforming, even if a portion in the vicinity of the contact face S601 is likely to retreat inward.

Since the rubber attachment portion 623 of the second side plate 621 abuts on the outer end face of the support plate 640, the rubber attachment portion 623 can also be suppressed from bending inward. Therefore, the autonomously standing display apparatus 601 can also increase the biasing force of the rubber 650. In FIG. 16B, for the same reasons as that in FIGS. 5B and 13A, the first display board 610 does not actually bend in the folded state.

Folded State

FIG. 17 is a perspective view of the autonomously standing display apparatus 601 in the folded state, according to the sixth embodiment.

The foot plate 625 is folded integrally with the second side plate 621, and is arranged on the second display board 620 and the bottom plate 630. Therefore, the external shape of the autonomously standing display apparatus 601 in the folded state, in a planar direction (in-plain direction VW), does not change in the presence or absence of the foot plate 625. As a result, the autonomously standing display apparatus 601 can be compactly folded.

As shown in FIG. 16B, in the autonomously standing display apparatus 601, the loop fasteners 682*a* and 682*b* maintain the folded state of the first display board 610 and support plate 640. As will be described later, in the folded state, a total length of the autonomously standing display apparatus 601 is equal to a length of the first display board 610. Therefore, even if the autonomously standing display apparatus 601 is in the folded state, the first display board 610 has a sufficient display area.

As a result, in cases where installation space cannot be secured in a shop or the like, the autonomously standing display apparatus 601 can be put up on a wall with the strap 681.

Dimension Setting

As shown in FIG. 16B, in the folded state, dimensions in the vertical direction Z viewed from the side face of each member, are set as shown below. The dimensions are set to satisfy: L61=L62+L63×L610, where L61 is a length between the hinge 660 and the hinge 665;

L62 is a length between the hinge 660 and the hinge 666;

L63 is a length between the hinge 666 and the hinge 665; and

L610 is a length of the first display board 610.

Since "L1=L2+L3," is satisfied, the autonomously standing display apparatus 601 can be folded flat, similarly to the first embodiment.

Since "L1=L2+L3≈L610," is satisfied, the autonomously standing display apparatus 601 can be folded into the same dimension as the length L610 of the first display board 610 in the vertical direction. As a result, as described above, even in the folded state, the autonomously standing display apparatus 601 can be hung so as to display the first display board 610.

Note that the autonomously standing display apparatus 601 may be provided with the rubber attachment portion 623 in the first side plate 611, similarly to the fourth embodiment (see FIG. 11). Even in this case, the above-mentioned effects are achieved by causing the rubber attachment portion 623 to abut on the support plate 640.

As described above, the autonomously standing display apparatus 601 is low in cost, since the main components are formed of a corrugated fiberboard. Further, the autonomously standing display apparatus 601 can improve the strength.

Seventh Embodiment

A description will be now made of a seventh embodiment of the present invention.

Note that, in the following descriptions and drawings of the seventh embodiment, portions similar in function to the sixth embodiment are assigned with identical reference numerals (or reference numerals having identical last digits), and redundant descriptions are omitted as appropriate.

Figure 18:
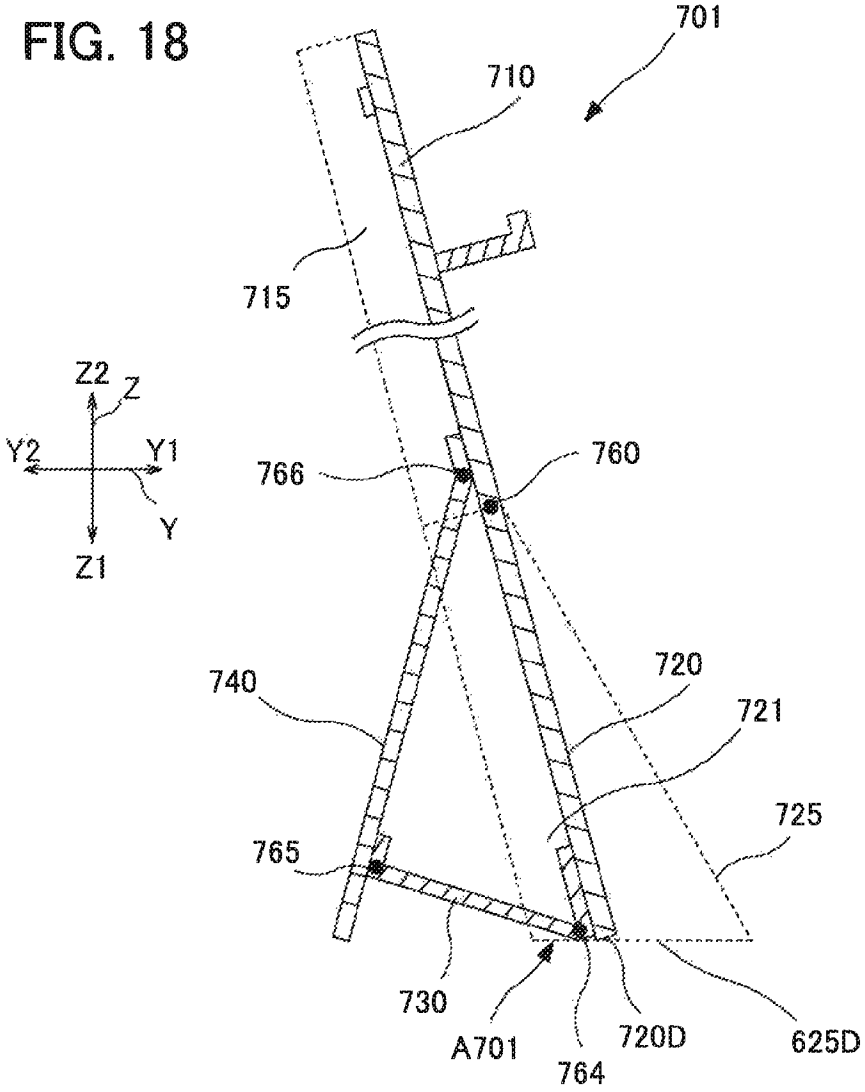
FIG. 18 is a sectional view of an autonomously standing display apparatus 701 in an autonomously standing state, according to a seventh embodiment, as viewed from a horizontal direction X.

FIG. 18 is a sectional view of an autonomously standing display apparatus 701 in an autonomously standing state, according to the seventh embodiment, as viewed from a horizontal direction X (this view corresponds to FIG. 16A).

A bottom plate 730 and a support plate 740 of the autonomously standing display apparatus 701 are formed of separate corrugated fiberboards, and are connected together at a portion composing a hinge 765.

A portion composing a hinge 764 in a front direction Y1 of the bottom plate 730 is connected to the second display board 720, so as to coincide with a lower end 720D of the second display board 720.

As a result, the lower portion of the support plate 740 protrudes in a lower direction Z1 beyond the bottom plate 730. The bottom plate 730 is arranged obliquely more upward in an upper direction Z2 and back direction Y2.

Even with this configuration, when the second side plate 721 is biased inward, an inner face of the second side plate 721 abuts on an outer end face of the bottom plate 730 (see an arrow A701). As a result, the autonomously standing display apparatus 701 achieves effects similar to those of the sixth embodiment.

The embodiments of the present invention have been described above; however, the present invention is not limited to the aforementioned embodiments; and various modifications and changes are possible, which are also within the technical scope of the present invention. The effects disclosed in the embodiments are merely examples of the most preferable effects arising from the present invention; and effects according to the present invention are not limited to the effects disclosed in the embodiments. Note that the aforementioned embodiments can be used in combination as appropriate, but detailed descriptions thereof are omitted herein

The invention claimed is:

1. An autonomously standing display apparatus comprising:

a first display board;

a first side plate rotatably connected to a side edge of the first display board;

a second display board rotatably connected to a lower edge of the first display board;

a second side plate rotatably connected to the first side plate and the second display board;

a bottom plate rotatably connected to a lower edge of the second display board;

a support plate, one edge of which is connected to an edge of the bottom plate opposite to the second display board, and the other edge of which is rotatably connected to a back face of the first display board; and a biasing member, wherein the first side plate is configured to be sustainable of an upstanding state in relation to the first display board or the second side plate is configured to be sustainable of an upstanding state in relation to the second display board and the first side plate is configured to be connected with the second side plate, whereby the first side plate maintains the upstanding state in relation to the first display board and the second side plate maintains the upstanding state in relation to the second display board, respectively, the first display board and the second display board maintain a flat-deployed state, and the first display board and the second display board which are deployed flat, the bottom plate, and the support plate constitute sides of a triangle of a sectional view to maintain an opened state, wherein the biasing member is configured to bias the first side plate or the second side plate inward, and the first side plate is configured to be connected with the second side plate, whereby the first side plate and the second side plate operate in conjunction with each other, the first side plate maintains the upstanding state in relation to the first display board and the second side plate maintains the upstanding state in relation to the second display board, the first display board and the second display board deploy autonomously flat in conjunction with the upstanding of the first side plate and the second side plate, and the first display board and the second display board which are deployed flat, the bottom plate, and the support plate autonomously change from a folded state into the opened state, and wherein the biasing member is an elastic member, one end of which is connected to the first side plate or the second side plate, and the other end of which is connected to an inner face of the support plate.

2. The autonomously standing display apparatus according to claim 1, wherein the first display board and the first side plate are configured to be rotatable and flatly deployable around a connection between the first display board and the first side plate, the second display board and the second side plate are configured to be rotatable and flatly deployable around a connection between the second display board and the second side plate, the first display board and the second display board are configured to be rotatable and foldable around a connection between the first display board and the second display board, the second display board and the bottom plate are configured to be rotatable and flatly deployable around a connection between the second display board and the bottom plate, the bottom plate and the support plate are configured to be rotatable and foldable around a connection between the bottom plate and the support plate, and the support plate and the first display board are configured to be rotatable and foldable around a connection between the support plate and the first display board, such that an entirety of the autonomously standing display apparatus is configured to be flatly foldable.

3. The autonomously standing display apparatus according to claim 1, wherein an attachment portion of the biasing member of the first side plate or the second side plate is biased inward to abut on an outer end of the support plate.

4. The autonomously standing display apparatus according to claim 1, wherein the support plate protrudes downward beyond the bottom plate; and the second side plate abuts on an outer end of the bottom plate.

5. The autonomously standing display apparatus according to claim 1, wherein the second side plate has a foot part which projects frontward beyond the second display board.

6. The autonomously standing display apparatus according to claim 1, wherein L1=L2 is satisfied, where L1 is a sum of a length of the second display board and a length of the bottom plate, and L2 is a sum of a length of the support plate and a length from the connection between the support plate and the first display board to the connection between the first display board and the second display board.

7. The autonomously standing display apparatus according to claim 1, wherein L61=L62+L63 is satisfied, where L61 is a length from the connection between the first display board and the second display board to the connection between the bottom plate and the support plate, L62 is a length from the connection between the first display board and the second display board to the connection between the first display board and the support plate, and L63 is a length from the connection between the first display board and the support plate to the connection between the support plate and the bottom plate.

8. An autonomously standing display apparatus comprising:

a first display board;

a first side plate rotatably connected to a side edge of the first display board;

a second display board rotatably connected to a lower edge of the first display board;

a second side plate rotatably connected to the first side plate and the second display board;

a bottom plate rotatably connected to a lower edge of the second display board;

a support plate, one edge of which is connected to an edge of the bottom plate opposite to the second display board, and the other edge of which is rotatably connected to a back face of the first display board; and a biasing member, wherein the first side plate is configured to be sustainable of an upstanding state in relation to the first display board or the second side plate is configured to be sustainable of an upstanding state in relation to the second display board and the first side plate is configured to be connected with the second side plate, whereby the first side plate maintains the upstanding state in relation to the first display board and the second side plate maintains the upstanding state in relation to the second display board, respectively, the first display board and the second display board maintain a flat-deployed state, and the first display board and the second display board which are deployed flat, the bottom plate, and the support plate constitute sides of a triangle of a sectional view to maintain an opened state, wherein the biasing member is configured to bias the first side plate or the second side plate inward, and the first side plate is configured to be connected with the second side plate, whereby the first side plate and the second side plate operate in conjunction with each other, the first side plate maintains the upstanding state in relation to the first display board and the second side plate maintains the upstanding state in relation to the second display board, the first display board and the second display board deploy autonomously flat in conjunction with the upstanding of the first side plate and the second side plate, and the first display board and the second display board which are deployed flat, the bottom plate, and the support plate autonomously change from a folded state into the opened state, and wherein the biasing member is an elastic member, one end of which is connected to the second side plate, and the other end of which is connected to an inner face of the bottom plate.

9. The autonomously standing display apparatus according to claim 8, wherein the first display board and the first side plate are configured to be rotatable and flatly deployable around a connection between the first display board and the first side plate, the second display board and the second side plate are configured to be rotatable and flatly deployable around a connection between the second display board and the second side plate, the first display board and the second display board are configured to be rotatable and foldable around a connection between the first display board and the second display board, the second display board and the bottom plate are configured to be rotatable and flatly deployable around a connection between the second display board and the bottom plate, the bottom plate and the support plate are configured to be rotatable and foldable around a connection between the bottom plate and the support plate, and the support plate and the first display board are configured to be rotatable and foldable around a connection between the support plate and the first display board, such that an entirety of the autonomously standing display apparatus is configured to be flatly foldable.

10. The autonomously standing display apparatus according to claim 8, wherein an attachment portion of the biasing member of the first side plate or the second side plate is biased inward to abut on an outer end of the support plate.

11. The autonomously standing display apparatus according to claim 8, wherein the support plate protrudes downward beyond the bottom plate; and the second side plate abuts on an outer end of the bottom plate.

12. The autonomously standing display apparatus according to claim 8, wherein the second side plate has a foot part which projects frontward beyond the second display board.

13. The autonomously standing display apparatus according to claim 8, wherein L1=L2 is satisfied, where L1 is a sum of a length of the second display board and a length of the bottom plate, and L2 is a sum of a length of the support plate and a length from the connection between the support plate and the first display board to the connection between the first display board and the second display board.

14. The autonomously standing display apparatus according to claim 8, wherein L61=L62+L63 is satisfied, where L61 is a length from the connection between the first display board and the second display board to the connection between the bottom plate and the support plate, L62 is a length from the connection between the first display board and the second display board to the connection between the first display board and the support plate, and L63 is a length from the connection between the first display board and the support plate to the connection between the support plate and the bottom plate.

* * * * *